US008590890B2

(12) United States Patent
Haruyama

(10) Patent No.: US 8,590,890 B2
(45) Date of Patent: Nov. 26, 2013

(54) MEDIUM CARRYING DEVICE AND IMAGE FORMING DEVICE

(75) Inventor: Masahiro Haruyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/334,377

(22) Filed: Dec. 22, 2011

(65) Prior Publication Data

US 2012/0161385 A1 Jun. 28, 2012

(30) Foreign Application Priority Data

Dec. 24, 2010 (JP) ..... 2010-288594

(51) Int. Cl.
*B65H 5/00* (2006.01)

(52) U.S. Cl.
USPC ..... 271/264; 399/114; 399/124

(58) Field of Classification Search
USPC ..... 271/264; 399/21, 16, 114, 124
See application file for complete search history.

(56) References Cited

U.S. PATENT DOCUMENTS 6,999,698 B2 * 2/2006 Yamauchi et al. ..... 399/121

FOREIGN PATENT DOCUMENTS

JP 63212663 A * 9/1988 ..... B65H 29/20
JP A-2009-067550 4/2009

* cited by examiner

*Primary Examiner* — Michael McCullough
(74) *Attorney, Agent, or Firm* — Muncy, Geissler, Olds & Lowe, PLLC

(57) ABSTRACT

An information processing device includes an opening and closing member that is configured to be movable between open and closed positions, and an interference member that is positioned in a middle of an opening and closing trajectory of the opening and closing member. The opening and closing member takes the open position after the opening and closing member moves in a direction away from the interference member and takes the closed position after the opening and closing member moves in a direction toward the interference member.

28 Claims, 21 Drawing Sheets

MEDIUM CARRYING DEVICE AND IMAGE FORMING DEVICE

CROSS REFERENCE TO RELATED APPLICATION

The present application is related to, claims priority from and incorporates by reference Japanese patent application No. 2010-288594, filed on Dec. 24, 2010.

TECHNICAL FIELD

The present application relates to a medium carrying device and an image forming device.

BACKGROUND

Conventionally, image forming devices, such as printers, photocopy machines, facsimile machines, multi-function peripherals (MFPs), which use electrographic method, and in particular printers, include a freely rockable opening and closing member that opens and closes a carrying path used for carrying media, such as sheets, with respect to the main device. However, depending on the positional relationship between the opening and closing member and other members, the other members often prevent the opening and closing of the opening and closing member.

The objects of the present application are to solve the above drawbucks.

SUMMARY

An information processing device of the present invention includese an opening and closing member that is configured to be movable between open and closed positions, and an interference member that is positioned in a middle of an opening and closing trajectory of the opening and closing member. The opening and closing member takes the open position after the opening and closing member moves in a direction away from the interference member and takes the closed position after the opening and closing member moves in a direction toward the interference member.

In addition, a medium carrying device according to the present application includes a carrying roller pair that is configured from first and second rollers and that carries a medium, a guide that guides the medium to a nip part defined by the carrying roller pair, a support part that supports the guide rockably and freely movably to the nip part, and a guide position changing part that is provided freely movably with respect to a device main body, that positions the guide at a guide position by moving the guide toward the nip part after rotating the guide as the guide position changing part moves in a first direction with respect to the device main body, and that positions the guide at a shunt position by moving the guide away from the nip part by moving the guide in a second direction with respect to the device main body. A tip end part of the guide is positioned in an interference area configured by the first and second rollers and a common external tangent line of the first and second rollers at the guide position and is positioned outside the interference area at the shunt position. In addition, the support part includes a rotational shaft formed on one of a support member and the guide, and a support opening formed on the other one of the support member and the guide, the support member being formed at a predetermined location on a frame of the device main body.

Moreover, a medium carrying device according to the present application includes a support member including a first regulation part and one of a support opening and a rotational shaft, the rotational shaft being movable in a first direction within the support opening, the first regulation part extending in parallel to the first direction, a guide including a first regulated part, a second regulated part, a third regulated part, and an other one of the support opening and the rotational shaft, the guide position being a position at which a tip end part of the guide is in an interference area defined by a carrying roller pair, a first shunt position being a position at which the tip end part of the guide is outside the interference area, a second shunt position being a position at which the guide is rotated and thereby the tip end part is farther from the carrying roller pair than the first shunt position, and a contact part that includes a second regulation part. The tip end part of the guide contacts the contact part at the second shunt position. Further, the first regulation part contacts the first regulated part, and the second regulation part contacts the third regulated part, when the guide is rotated by the contact part and reaches the first shunt position. The tip end part enters the interference area, and the second regulation part contacts the second regulated part, when the guide is moved in the first direction and to the guide position by the contact part.

Therefore, the guide is positioned at a shunt position only by moving the guide in the second direction. Accordingly, a jam in the medium carrying device is easily released.

In addition, the tip end part of the guide is located outside the interference area while the guide is positioned at the first shunt position. Therefore, when he guide 43 is rocked between the first and second shunt positions for removing the jam and attaching and detaching the various units, the guide and the first registration rollers are prevented from interfering from each other.

Moreover, when the guide is positioned at the guide position, the guide is moved in the vicinity of the nip part. Therefore, the sheet is accurately guided to the vicinity of the nip part. Accordingly, the sheet is smoothly carried without the folding phenomenon and the like in which front end of the sheet hits the first registration rollers and is folded to occur.

Further, the guide opens and closes the medium crrying path when the guide moves in a direction relative to the interference member. Accordingly, the opening and closing of the guide are not prevented by the first registration roller, which is positioned in the middle of the opening and closing route of the guide.

Further, the rotation of the guide and movement of the guide from the shunt positions to the guide position is smoothly and accurately accomplished.

DETAILED DESCRIPTION OF EMBODIMENTS

Figure 1:
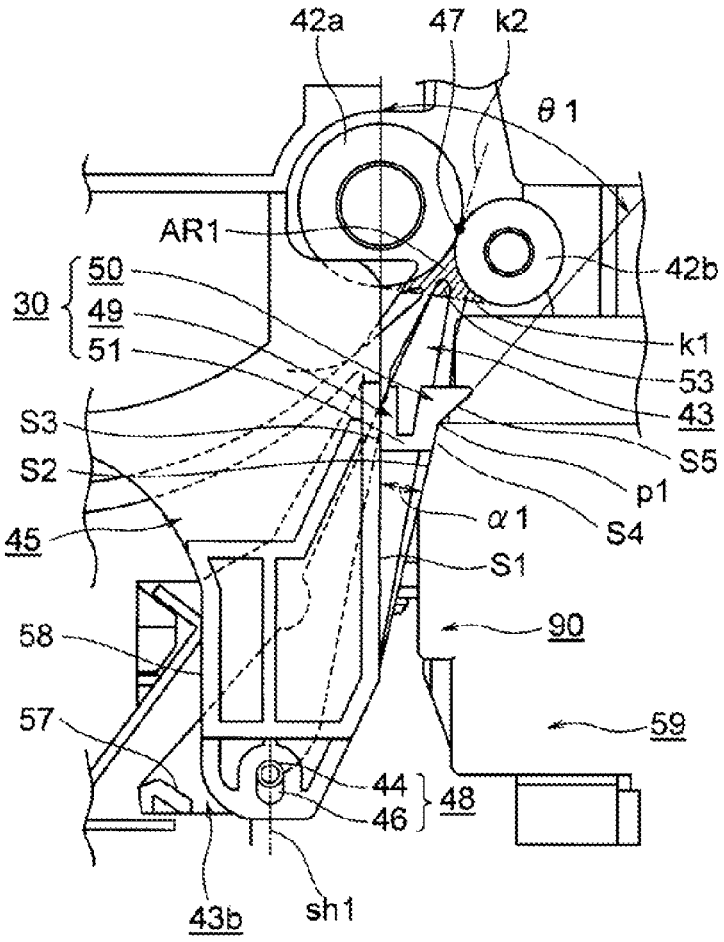
FIG. 1 is a first cross-sectional view illustrating a main part of a medium carrying device according to a first embodiment of the present application.

Embodiments of the present application are described in detail below with reference to the drawings. In the present embodiments, a color printer is explained as an example of image forming device, which is an information processing device as well as a medium carrying device.

In the below explanations of the embodiments, terms, such as "upper," "lower," "vertical," and "horizontal" are used. However, these terms indicate directions of the object(s) shown in the drawings and are not necessarily to indicate the directions in the actual device.

Figure 2:
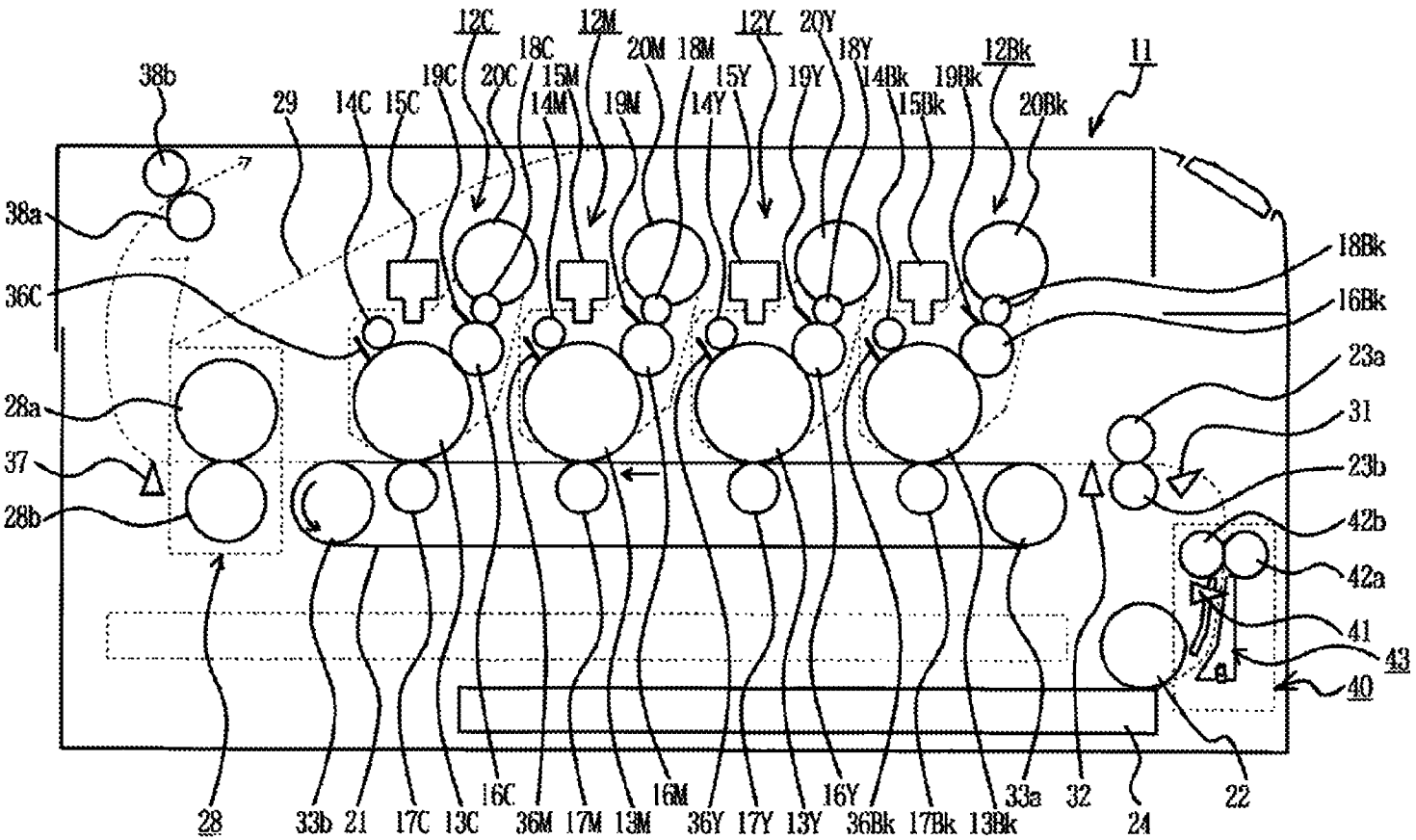
FIG. 2 is a conceptual diagram of a printer according to the first embodiment of the present application.

FIG. 2 is a conceptual diagram of a printer according to the first embodiment of the present application.

As shown in the drawing, in a printer 11, image forming units 12Bk, 12Y, 12M and 12C that configure an image forming parts for black, yellow, magenta and cyan, respectively, are arranged from the upstream side to the downstream side of sheet carrying direction of a sheet (not shown) as a medium. The image forming units 12Bk, 12Y, 12M and 12C form images in black, yellow, magenta and cyan, respectively. Other than normal paper, over-head-projector (OHP) sheets, envelopes, copy paper, special paper and the like may be used as the sheet.

The image forming units 12Bk, 12Y, 12M and 12C respectively include photosensitive drums 13Bk, 13Y, 13M and 13C as image carriers and photosensitive members, charging rollers 14Bk, 14Y, 14M and 14C as charging devices that uniformly charge surfaces of the photosensitive drums 13Bk, 13Y, 13M and 13C, development rollers 16Bk, 16Y, 16M and 16C as developer carrier that attach toner as developer on electrostatic latent images as latent images formed on the surfaces of the photosensitive drums 13Bk, 13Y, 13M and 13C and form toner images in black, yellow, magenta and cyan as developer images, which are visible images, and the like.

Moreover, toner supply rollers 18Bk, 18Y, 18M and 18C as developer supply members are arranged to press (contact) the development rollers 16Bk, 16Y, 16M and 16C, respectively. The toner supply rollers 18Bk, 18Y, 18M and 18C supply toners supplied from toner cartridges 20Bk, 20Y, 20M and 20C as developer cartridges, to the development rollers 16Bk, 16Y, 16M and 16C, respectively. Development blades 19Bk, 19Y, 19M and 19C as developer restriction members contact the development rollers 16Bk, 16Y, 16M and 16C, respectively. The development blades 19Bk, 19Y, 19M and 19C form a thin layer of the toner supplied from the toner supply rollers 18Bk, 18Y, 18M and 18C on the development rollers 16Bk, 16Y, 16M and 16C, respectively.

Furthermore, cleaning blades 36Bk, 36Y, 36M and 36C as first cleaning members and first removal members are arranged to contact the photosensitive drums 13Bk, 13Y, 13M and 13C, respectively. The cleaning blades 36Bk, 36Y, 36M and 36C are formed from elastic bodies, such as urethane rubber, and clean the surface of the photosensitive drums 13Bk, 13Y, 13M and 13C, respectively. The cleaning blades 36Bk, 36Y, 36M and 36C remove toner remained on the photosensitive drums 13Bk, 13Y, 13M and 13C, respectively, after the transfer of electrostatic latent images, by scraping off the toner thereon, as described below.

Development units as development parts for the respective image forming units 12Bk, 12Y, 12M and 12C are respectively configured by the development rollers 16Bk, 16Y, 16M and 16C, the toner supply rollers 18Bk, 18Y, 18M and 18C, the development blades 19Bk, 19Y, 19M and 19C, the toner cartridges 20Bk, 20Y, 20M and 20C, and the like.

In addition, above the photosensitive drums 13Bk, 13Y, 13M and 13C in the respective image forming units 12Bk, 12Y, 12M and 12C, the light emitting display (LED) heads 15Bk, 15Y, 15M and 15C as exposure devices are respectively arranged to face the photosensitive drums 13Bk, 13Y, 13M and 13C. The LED heads 15Bk, 15Y, 15M and 15C respectively exposes the photosensitive drums 13Bk, 13Y, 13M and 13C and form electrostatic latent images based on the image data of the respective colors.

A transfer unit is arranged below the photosensitive drums 13Bk, 13Y, 13M and 13C in the respective image forming units 12Bk, 12Y, 12M and 12C. The transfer unit stretches and freely travels in the direction of the arrow. The transfer unit includes an endless carrying belt 21 as a carrying member for carrying the sheet and as a first transfer member, a carrying belt driven roller 33*a* that rotates in accordance with the travelling of the carrying belt 21 and is supported by a spring (not shown) for maintaining a constant tension on the carrying belt 21, a carrying belt drive roller 33*b*, and transfer rollers 17Bk, 17Y, 17M and 17C as second transfer members that are arranged to face the respective photosensitive drums 13Bk, 13Y, 13M and 13C over the carrying belt 21. The transfer rollers 17Bk, 17Y, 17M and 17C charge the sheet at the polarity opposite from the polarity of the toner and transfer the toner images in the respective colors sequentially over each other to form a color image.

Below the printer 11, a sheet supply mechanism for supplying sheets to the carrying path is arranged. The sheet supply mechanism includes a sheet cassette 24 as a medium container, a sheet supply roller 22 that uses a separation flap or the like (not shown) to separate each sheet and feed from the sheet cassette 24, a medium carrying device 40 arranged on the downstream side of the sheet supply roller 22 in the sheet carrying direction, and the like.

The medium carrying device 40 includes a first entrance sensor 41 as a first medium detector that detects a sheet fed from the sheet supply roller 22, a first registration rollers 42*a* and 42*b* as a first carrying roller pair for carrying the sheet fed from the sheet supply roller 22, and an opening and closing member (e.g., guide 43) as a guide member that is arranged on the upstream side of a nip part formed between the first registration rollers 42*a* and 42*b* and that guides the sheet to the nip part. The opening and closing member is configured to be movable between at least two different positions. For example, one is an open position. The other is a closed position. In the embodiment, the guide 43 is mobable between open and closed positions. The first registration roller 42*a* configures a first roller, and the first registration roller 42*b* configures a second roller.

Moreover, on the downstream side of the medium carrying device 40 in the sheet carrying direction, a second entrance sensor 31 as a second medium detector for detecting the sheet ejected from the medium carrying device 40, second registration rollers 23*a* and 23*b* as a second carrying roller pair for carrying the sheet ejected from the medium carrying device 40, a writing sensor 32 as a third medium detector for detecting the sheet ejected from the second registration rollers 23*a* and 23*b*, and the like are sequentially arranged along the sheet carrying direction. The second registration roller 23*a* configures a first roller, and the second registration roller 23*b* configures a second roller.

The image forming units 12Bk, 12Y, 12M and 12C and the transfer unit are arranged on the downstream side of the writing sensor 32 in the sheet carrying direction. On the further downstream side, a fuser 28 is arranged as a fusion device for fixing the color toner images on the sheet to form a color image and as a fusion unit. The fuser 28 includes a fusion roller 28*a* as a first fusing roller and a pressure roller 28*b* as a second fusing roller. A heater (halogen lamp) (not shown) is arranged as a heating body in the fusion roller 28*a*.

Further, on the downstream side of the fusion 28 in the sheet carrying direction, an ejection sensor 37 as a third medium detector for detecting the sheet ejected from the fuser 28, ejection rollers 38*a* and 38*b* as a third carrying roller pair for carrying the sheet ejected from the fuser 38, and the like are arranged. The sheet is ejected to a stacker 29 by the ejection rollers 38*a* and 38*b*. The ejection roller 38*a* configures a first roller, and the ejection roller 38*b* configures a second roller.

In addition, other carrying roller pairs (not shown) that are respectively confirmed by first and second rollers are arranged in the carrying path in an interval that is less than the minimum medium intervals needed for carrying each sheet. A switching blade (not shown) as a switching member for switching the carrying path, and the like are also arranged in the carrying path.

Next, a control device for the above-configured printer 11 is explained.

Figure 3:
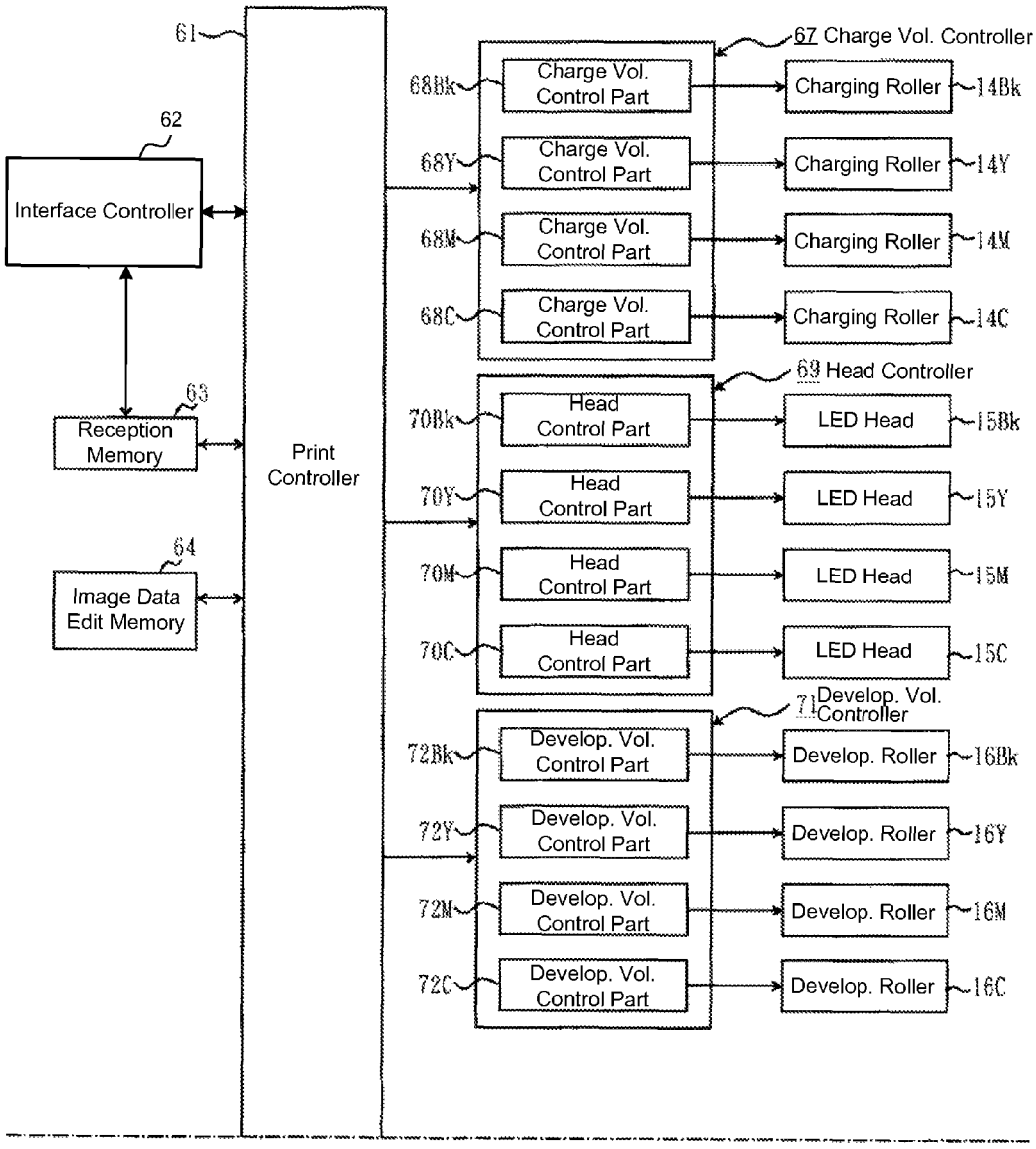
FIG. 3 is a first block diagram of a control device of the printer according to the first embodiment of the present application.
Figure 4:
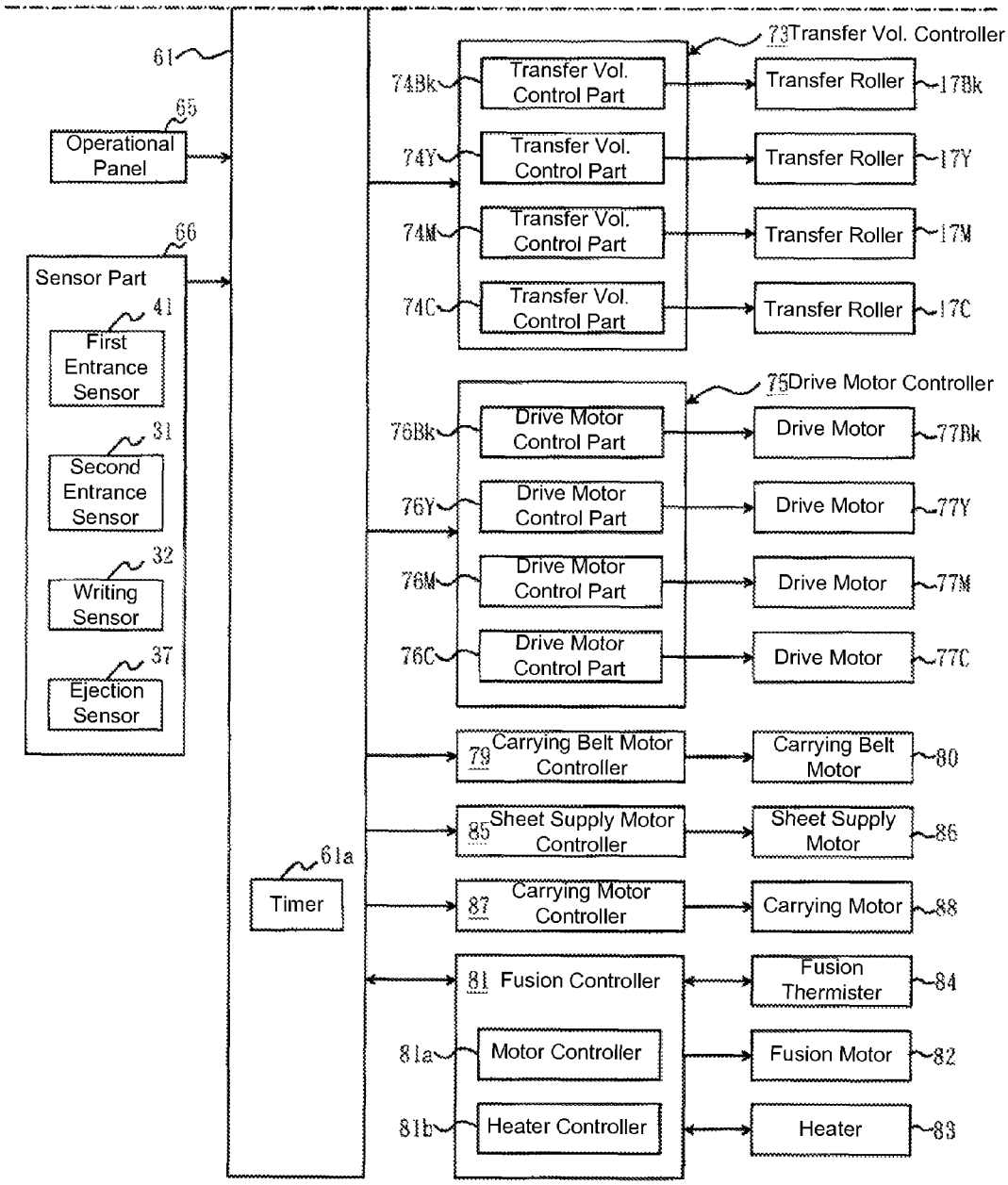
FIG. 4 is a second block diagram of the control device of the printer according to the first embodiment of the present application.

FIG. 3 is a first block diagram of a control device of the printer according to the first embodiment of the present application. FIG. 4 is a second block diagram of the control device of the printer according to the first embodiment of the present application. The first and second block diagrams shown in FIGS. 3 and 4 separately illustrates the control device for the printer.

In the figures, reference numeral 61 is a print controller as a controller that includes a microprocessor, a read-only memory (ROM), a random access memory (RAM), input and output ports, a timer (all not shown) and the like. The print controller 61 controls the entire print operations of the printer 11 (FIG. 2) for forming a color image based on print data and a control command received from a host computer (not shown) as a host device via an interface controller 62. The interface controller 62 transmits information that shows a status of the printer 11 to the host computer, analyzes control commands received from the host computer and records the received print data in a reception memory 63 by each color.

The print data transmitted from the host computer via the interface controller 62 is temporarily recorded in the reception memory 63 and is sent to the LED heads 15Bk, 15Y, 15M and 15C after being edited by the print controller 61 and recorded in an image data edit memory 64 as image data formed from respective color image data for sending to the LED heads 15Bk, 15Y, 15M and 15C.

In addition, reference numeral 65 is an operational panel (touch panel) as an operation part. The operational panel 65 includes switches (not shown) as operational elements by which the user inputs instructions to the printer 11, and an LED (not shown) to display the status of the printer. The operational panel 65 also functions as a display.

Reference numeral 66 is a sensor part that is configured from a plurality of sensors (the first entrance sensor 41, second entrance sensor 31, writing sensor 32 and ejection sensor 37) that detect carrying positions of the sheet. Sensor outputs from each sensor of the sensor part 66 are sent to the print controller 61.

To the print controller 61, a charge voltage controller 67, a head controller 69, a development voltage controller 71, a transfer voltage controller 73, a drive motor controller 75 as a first drive controller, a carrying belt motor controller 79 as a second drive controller, a fusion controller 81, a sheet supply motor controller 85 and a carrying motor controller 87 are connected as respective element controllers.

The charge voltage controller 67 receives an instruction from the print controller 61 and applies a charge voltage to the respective charging rollers 14Bk, 14Y, 14M and 14C to charge the surfaces of the photosensitive drums 13Bk, 13Y, 13M and 13C. The charge voltage controller 67 includes charge voltage control parts 68Bk, 68Y, 68M and 68C for controlling the respective colors and controls voltages applied to the respective charging rollers 14Bk, 14Y, 14M and 14C.

The head controller 69 receives instructions from the print controller 61 and reads out the image data of respective colors recorded in the image data editing memory 64. Then, the head controller 69 sends the image data of respective colors to the LED heads 15Bk, 15Y, 15M and 15C and causes LED elements of an LED array (not shown) to selectively emit light and to expose the surfaces of the photosensitive drums 13Bk, 13Y, 13M and 13C by irradiating the light, thereby forming electrostatic latent images on the surfaces of the photosensitive drums 13Bk, 13Y, 13M and 13C. The head controller 69 includes heat control parts 70Bk, 70Y, 70M and 70C for controlling the heads for respective colors and sends image data to the respective LED heads 15Bk, 15Y, 15M and 15C at predetermined timing.

The development voltage controller 71 receives instructions from the print controller 61 and applies development voltages to the development rollers 16Bk, 16Y, 16M and 16C, to cause toner to be attached onto the electrostatic latent images formed on the photosensitive drums 13Bk, 13Y, 13M and 13C, thereby forming toner images. The development voltage controller 71 includes development voltage control parts 72Bk, 72Y, 72M and 72C for controlling development for the respective colors and controls the voltages applied to the development rollers 16Bk, 16Y, 16M and 16C, thereby forming the toner images at the part of the photosensitive drums 13Bk, 13Y, 13M and 13C that is exposed by the LED heads 15Bk, 15Y, 15M and 15C, respectively.

The transfer voltage controller 73 receives instructions from the print controller 61 and applies transfer voltages to the transfer rollers 17Bk, 17Y, 17M and 17C to transfer the toner images formed on the photosensitive drums 13Bk, 13Y, 13M and 13C to the sheet. The transfer voltage controller 73 includes transfer voltage control parts 74Bk, 74Y, 74M and 74C for controlling transfers for the respective colors and for sequentially transferring the respective toner images to the sheet.

The drive motor controller 75 receives instructions from the print controller 61 and drives drive motors 77Bk, 77Y, 77M and 77C as drive parts for forming images, to rotate the respective photosensitive drums 13Bk, 13Y, 13M and 13C, charging rollers 14Bk, 14Y, 14M and 14C and development rollers 16Bk, 16Y, 16M and 16C. The drive motor controller 75 includes drive motor control parts 76Bk, 76Y, 76M and 76C for controlling the drives for the respective colors.

The sheet supply motor controller 85 receives instructions from the print controller 61 and drives a sheet supply motor 86 as a sheet drive part to rotate the sheet supply roller 22. The carrying motor controller 87 receives an instruction from the print controller 61 and drives a carrying motor 88 as a carrying drive part, to rotate the first registration rollers 42*a* and 42*b* and the second registration rollers 23*a* and 23*b*. The carrying belt motor controller 79 receives an instruction from the print controller 61 and drives a carrying belt motor 80 as a travel drive motor for the carrying belt 21 to rotate the carrying belt drive roller 33*b*, thereby causing the carrying belt 21 to travel.

The fusion controller 81 receives an instruction from the print controller 61 and applies a fusion voltage to the heater 83 provided in the fusion roller 28*a* of the fuser 28, thereby fixing the toner image transferred onto the sheet. The fusion controller 81 causes a heater controller 81*b* to switches ON and OFF of the heater 83 based on a temperature detected by a fusion thermister 84 and causes a motor controller 81*a* to drive a fusion motor 82 as a fusion drive part to rotate the fusion roller 28*a*, the pressure roller 28*b* and the ejection rollers 38*a* and 38*b* when the fuser 28 reaches a predetermined set temperature.

Next, operations of the above-configured printer 11 are explained.

When a print instruction is received by receiving a control command and print data transmitted from the host computer via the interface controller 62, the print controller 61 sends a predetermined carrying speed to the sheet supply motor controller 85 and the carrying motor controller 87 to drive the sheet supply motor 86 and the carrying motor 88. Accordingly, the sheet supply roller 22 rotates, and each sheet is feed from the sheet cassette 24 and sent to the medium carrying device 40. When the sheet is detected by the first entrance sensor 41 provided at the medium carrying device 40 and when a sensor output of the first entrance sensor 41 is sent to the print controller 61, carrying control process means (not shown) in the print controller 61 performs a carrying control process and determines whether or not the sheet was normally supplied by the sheet supply roller 22. If the sheet is was not supplied normally, an oblique traveling of the sheet is corrected by impacting the front end of the sheet to the first registration rollers 42*a* and 42*b* by performing the sheet supply operation again or by controlling the drive timing for the first registration rollers 42*a* and 42*b* after determining the position of the front end of the sheet or the like.

After being detected by the second entrance sensor 31, the sheet is sent to the second registration rollers 23*a* and 23*b* and to the image forming unit 12Bk as is further carried by the rotation of the second registration rollers 23*a* and 23*b*.

For the image forming units 12Bk, 12Y, 12M and 12C, the respective photosensitive drums 13Bk, 13Y, 13M and 13C, charging rollers 14Bk, 14Y, 14M and 14C, development roller 13Bk, 16Y, 16M and 16C, toner supply rollers 18Bk, 18Y, 18M and 18C, carrying belt drive roller 33*b*, transfer rollers 17Bk, 17Y, 17M and 17C and the like start rotating substantially at the same time as when the sheet is fed from the sheet supply roller 22.

At this time, voltage application process means (not shown) in the print controller 61 performs a voltage application process and instructs application of a predetermined voltage, that is, a negative voltage at approximately −1,000 [V] in the present embodiment, to the charge voltage controller 67. Then, the charge voltage controller 67 applies the negative voltage to the charging rollers 14Bk, 14Y, 14M and 14C to uniformly charge the surface of the respective photosensitive drums 13Bk, 13Y, 13M and 13C.

Then, the toners used for the printing are supplied from the toner cartridges 20Bk, 20Y, 20M and 20C to the supply rollers 18Bk, 18Y, 18M and 18C, and are supplied to the development rollers 16Bk, 16Y, 16M and 16C via the toner supply rollers 18Bk, 18Y, 18M and 18C. The toners supplied to the development rollers 16Bk, 16Y, 16M and 16C are charged (frictionally charged) by the developments blades 19Bk, 19Y, 19M and 19C.

In addition, as the photosensitive drums 13Bk, 13Y, 13M and 13C rotate, the carrying belt drive roller 33*b* rotates, and thereby the carrying belt 21 travels. The circumferential velocity of the photosensitive drums 13Bk, 13Y, 13M and 13C is configured the same as the traveling velocity of the carrying belt 21.

While the sheet is sent from the second registration rollers 23*a* and 23*b* to the image forming unit 12Bk, the writing sensor 32 detects the sheet. After elapsing predetermined time thereafter, image forming process means performs an image forming process to send an instruction for exposure to the head controller 69, causing the head controller 96 to drive the respective LED heads 15Bk, 15Y, 15M and 15C. When the exposure is performed by the respective LED heads 15Bk, 15Y, 15M and 15C, electrostatic latent images are formed on the surfaces of the respective photosensitive drums 13Bk, 13Y, 13M and 13C.

Next, when the electrostatic latent images are sent to a position to face the photosensitive rollers 16Bk, 16Y, 16M and 16C in accordance with rotation of the photosensitive drums 13Bk, 13Y, 13M and 13C, the image forming process means sends an instruction to apply a predetermined voltage, that is, a negative voltage in the present embodiment, to the development voltage controller 71. At this time, the development voltage controller 71 applies the negative voltage to each of the development rollers 16Bk, 16Y, 16M and 16C to attach the toners on the development rollers 16Bk, 16Y, 16M and 16C to the respective photosensitive drums 13Bk, 13Y, 13M and 13C and to develop the electrostatic latent images, thereby forming the toner images.

Then, the sheet is sent between the photosensitive drums 13Bk, 13Y, 13M and 13C and the respective transfer rollers 17Bk, 17Y, 17M and 17C in accordance with the travelling of the carrying belt 21. In addition, when the toner images formed on the surfaces of the photosensitive drums 13Bk, 13Y, 13M and 13C are carried to the respective positions to face the carrying belt 21, the print controller 61 sends an instruction to the transfer voltage controller 73 to apply the predetermined voltage, that is, a positive voltage of +3,000 (V) in the present application. At this time, the transfer voltage controller 73 applies the positive voltage to the transfer rollers 17Bk, 17Y, 17M and 17C to transfer the respective toner images onto the sheet.

Then, the toners that remain on the surfaces of the photosensitive drums 13Bk, 13Y, 13M and 13C after the transfer are scraped off and removed by the respective cleaning blades 36Bk, 36Y, 36M and 36C.

As a result, a color toner image forms as the toner images in the respective colors formed in the image forming units 12Bk, 12Y, 12M and 12C are sequentially formed on the sheet.

Subsequently, the sheet is sent to the fuser 28, heated and pressed between the heating roller 28*a* and the pressure roller 28*b*, thereby causing the color toner image to be fixed on the sheet. When the sheet is detected by the ejection sensor 37 after the fusion is completed, the sheet is ejected to the stacker by the ejection rollers 38*a* and 38*b*. The print controller 61 determines whether a jam has occurred and detects a length of the sheet after fusion based on a sensor output of the ejection sensor 37.

In the carrying path for carrying the sheet, other carrying roller pairs are arranged in addition to the various carrying roller pairs including the first registration rollers 42*a* and 42*b*, the second registration rollers 23*a* and 23*b*, and the ejection rollers 38*a* and 38*b*. The fusion roller 28*a* and the pressure roller 28*b* also function as a carrying roller pair that carries the sheet.

Furthermore, for the first carrying roller pair, for example, a nip part is formed between the first registration rollers 42*a* and 42*b* that contact each other, and the guide 43 is arranged before the first registration rollers 42*a* and 42*b*, that is, on the upstream side of the first registration rollers 42*a* and 42*b* in the sheet carrying direction, to allow the front end of the sheet to smoothly advance to the nip part. The guide 43 includes a support part and is arranged freely rockable about the support part, such that a jam when it occurs can be released and that removal of various units, such as the image forming units 12Bk, 12Y, 12M and 12C, the transfer unit, the fusion unit and the like, of the printer main body, that is, a device main body, is made easy.

However, if a trajectory of the tip end of the guide 43 that is drawn when the guide 43 rocks exists in the interference area configured and surround by the first registration rollers 42*a* and 42*b* and a common external tangent line of the first registration rollers 42*a* and 42*b*, the guide 43 and the first registration rollers 42*a* and 42*b* interfere when the guide is rocked to release the jam or remove the various units.

Therefore, a consideration may be made to arrange the guide 43 such that the tip end does not enter the interference area. However, in that case, the front tip is separated from the nip part of the first registration rollers 42*a* and 42*b*. As such, the sheet cannot be accurately guided to the vicinity of the nip part by the guide 43.

Next, the medium carrying device according to the present application that accurately guides the sheet to the vicinity of the nip part of the first registration rollers 42*a* and 42*b* by the guide 43, thereby allowing smooth carrying of the sheet, is explained.

Figure 5:
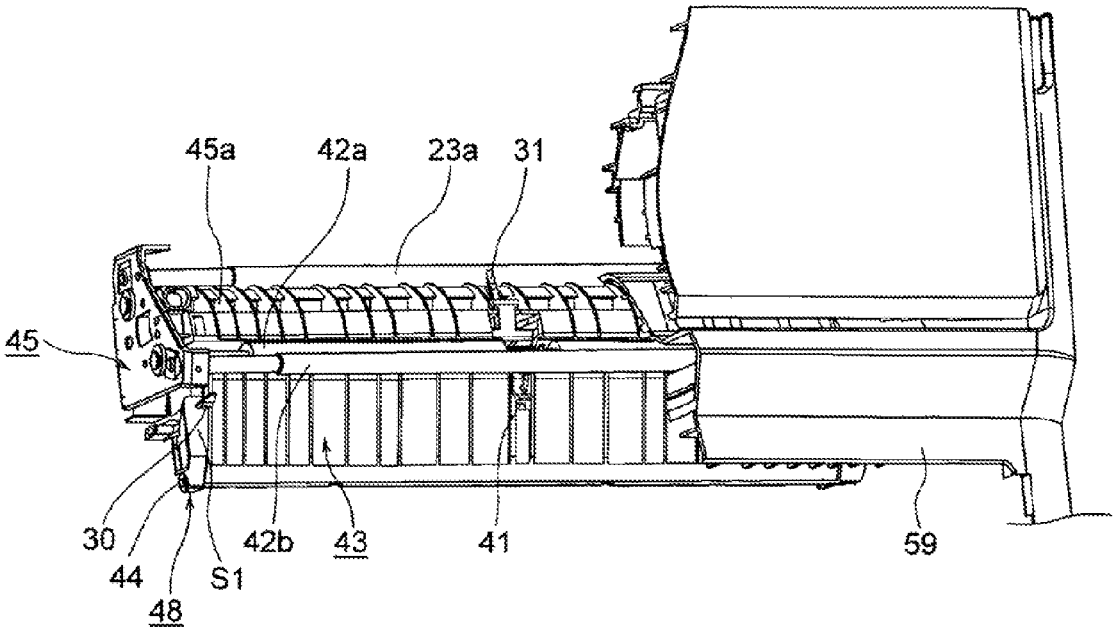
FIG. 5 is a first perspective view illustrating the main part of the medium carrying device according to the first embodiment of the present application.
Figure 6:
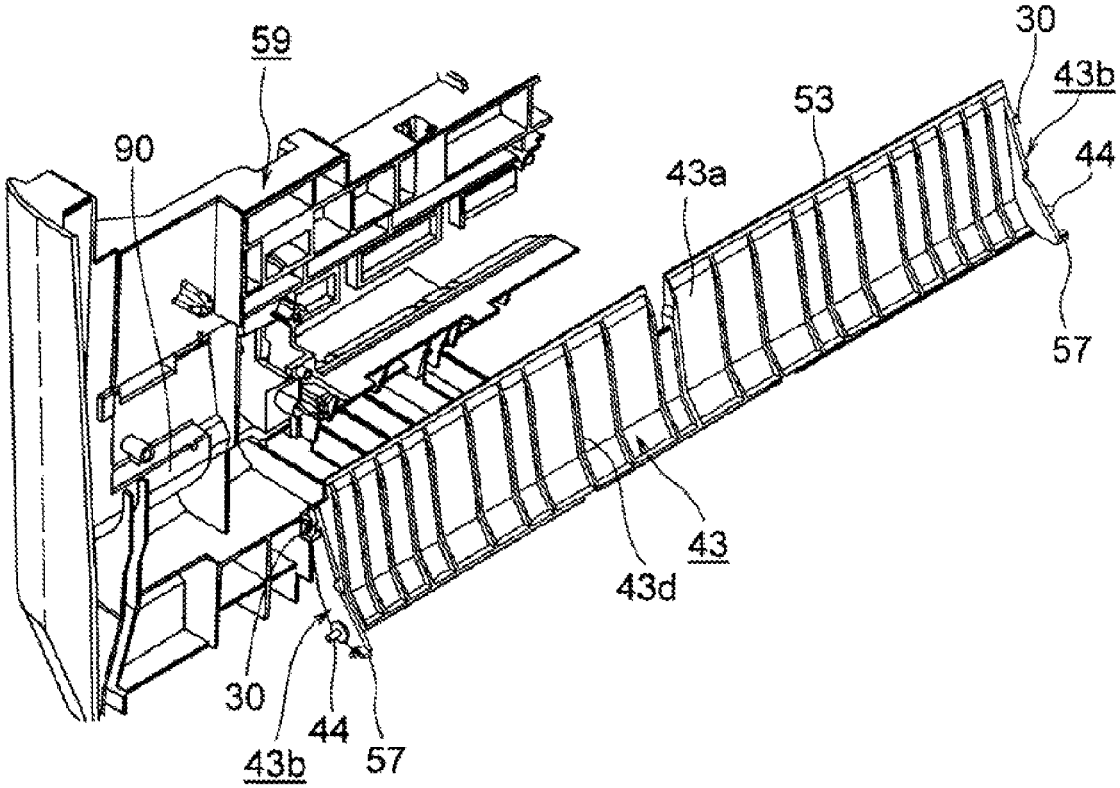
FIG. 6 is a second perspective view illustrating the main part of the medium carrying device according to the first embodiment of the present application.
Figure 7:
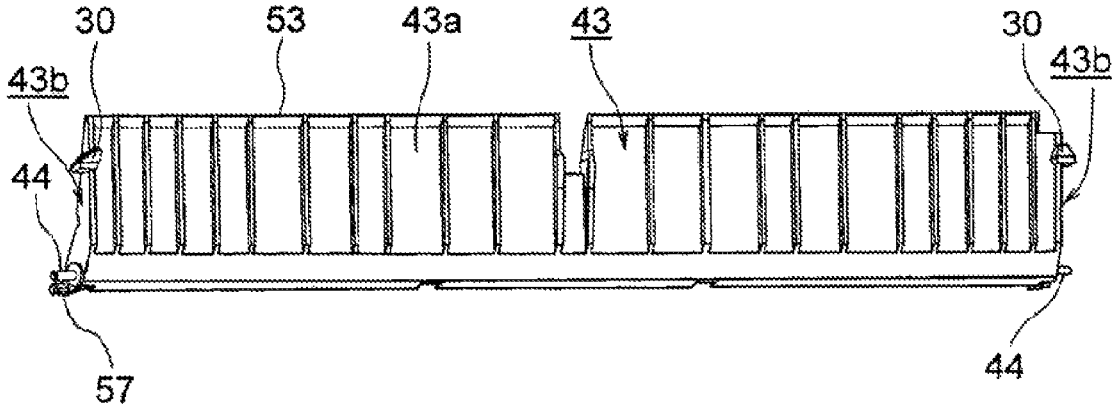
FIG. 7 is a front view of a guide according to the first embodiment of the present application.
Figure 8:
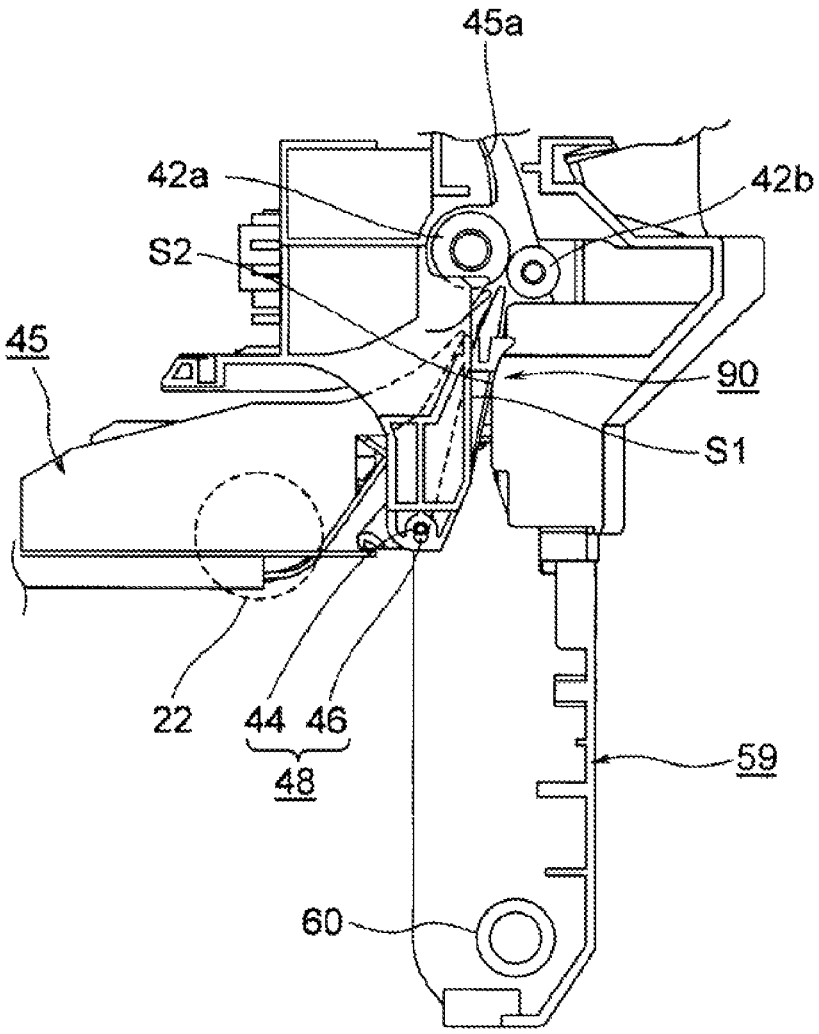
FIG. 8 is a second cross-sectional view illustrating the main part of the medium carrying device according to the first embodiment of the present application.

FIG. 1 is a first cross-sectional view illustrating a main part of a medium carrying device according to the first embodiment of the present application. FIG. 5 is a first perspective view illustrating the main part of the medium carrying device according to the first embodiment of the present application. FIG. 6 is a second perspective view illustrating the main part of the medium carrying device according to the first embodiment of the present application. FIG. 7 is a second cross-sectional view illustrating the main part of the medium carrying device according to the first embodiment of the present application. FIG. 8 is a second cross-sectional view illustrating a main part of a medium carrying device according to the first embodiment of the present application.

In the figures, reference numeral 22 is the sheet supply roller. Reference numeral 23*a* is the second registration roller. Reference numeral 31 is the second entrance sensor. Reference numeral 41 is the first entrance sensor. Reference numerals 42*a* and 42*b* are the first registration rollers. Reference numeral 43 is the guide arranged in the sheet carrying path from the sheet supply roller 22 to the first registration rollers 42*a* and 42*b*. Reference numeral 45 is the support member as a second support body that is formed at a predetermined location in a frame (not shown) as a first support body in the device main body and that supports the first registration rollers 42 and 42*b* and freely rockably the guide 43. Reference numeral 45*a* is a sheet guide surface of the support member 45. Reference numeral 59 is a cover 50 as a guide position changing part and as a opening and closing member that configures a part of the frame, that is supported freely rockably (movable in first and second directions) to the device main by with a support shaft 60 as a rocking center, that covers the first registration rollers 42*a* and 42*b* and the guide 43, and that causes the guide 43 to rock based on the opening and closing of the cover 59. Reference numeral 90 is a contact rib as a contact part and a reinforcement part that faces the support member 45 and is formed to protrude at a position outside a range defined by the maximum sheet width in an inner circumference of the cover 59.

The maximum sheet width is a maximum value of a width of a sheet in a direction perpendicular to the carrying direction of the sheet. This value varies depending on the size of the sheet and its carrying direction (portrait or landscape direction of the sheet).

The guide 43 includes a main body part 43*a* formed to extend in a longitudinal direction, and sidewall parts 43*b* that are formed integrally with, and protrude in a perpendicular direction from, the main body part 43*a* at a position of the main body part 43 outside the range defined by the maximum sheet width.

The main body part 43*a* is formed in a plate shape with a predetermined thickness and is bent at a predetermined angle near the lower end. In addition, ribs 43*d* as reinforcement part that extend in the sheet carrying direction are formed at a plurality of locations on the main body part 43*a* in the longitudinal reaction.

Each of the sidewall parts 43*b* is integral with the main body part 43*a* at a tip end part 53 of the guide 43 and is in a triangular shape that increases its area towards the lower direction and in the width direction of the main body part 43*a*. Near the lower end of each of the sidewall part 43*b*, a rotational shaft 44 as a first engagement part and a stopper 57 as a second engagement part are formed. Near the upper end, an engagement protrusion 30 as a contacted part is formed. The rotational shaft 44, stopper 57 and engagement protrusion 30 are respectively formed to project in the longitudinal direction of the guide 43. Because the sidewall parts 43*b* are located at the respective positions outside the maximum sheet width, edges of the sheet do not contact the stoppers 57 or the engagement protrusions 30 even if various sheets are carried.

While the first registration rollers 42*a* and 42*b* are supported freely rotatably at a fixed position by the support member 45, the guide 43 is supported freely rockably by the support part 48 and freely movably in a preset direction, that is, in the sheet carrying direction (with respect to the nip part 47 between the first registration rollers 42*a* and 42*b*) in the present embodiment. The guide 43 rocks, and is moved in the sheet carrying direction, in accordance with the opening and closing of the cover 59.

When the cover 59 is closed (or closed position), the guide 43 is positioned at a position to guide the sheet, that is, a guide position. When the cover 59 is opened, the guide 43 is positioned at positions not to guide the sheet, that is, first and second shunt positions. At the guide position, the tip end part 53 of the guide is positioned near the nip part 47, that is, in the interference area AR1 surrounded by the first registration rollers 42*a* and 42*b* and the common external tangent line k1 of the first registration rollers 42*a* and 42*b*. At the first shunt position, the tip end part 53 of the guide is positioned outside the interference area AR1. At the second shunt position, the guide 43 rotates from the first shunt position and opens the carrying path. Therefore, the opening and closing of the guide 43 is accomplished as the guide 43 moves in a direction relative to the first registration roller 42*b*.

Therefore, in the present embodiment, when the cover 59 is closed by rotating (moving) in a closing direction as a first direction with respect to the device main body, the guide 43 is positioned at the first shunt position by being rotated from the second shunt position. Then, the guide 43 is positioned at the guide position by moving toward the nip part 47 (in a direction toward the first registration rollers 42*a* and 42*b*). Moreover, when the cover 59 is opened (or open position) by rotating (moving) in an opening direction as a second direction with respect to the device main body, the guide 43 is moved from the guide position at a distance away from the nip part 47 (in a direction away from the first registration rollers 42*a* and 42*b*) and is positioned at the first shunt position. At this time, the cover 59 is opened while the later-discussed first regulation surface S1 formed on the cover 59 is in contact with the guide 43 and while the later-discussed sliding part p1 formed on the cover 59 is in contact with the later-discussed second regulated surface S5 formed on the guide 43. Therefore, the rotational shaft 44 moves to the first shunt position as the rotational shaft 44 is regulated by the support opening 46 in the direction in which the guide 43 is separated away from the first registration rollers 42*a* and 42*b*, which are the interference members. Then, the guide 43 is positioned at the second shunt position as being rotated from the first shunt position.

As a result, a support opening 46 is formed as a first engaged part that is configured by an oblong opening (oval opening), near the lower end of the support member 45. The rotational shaft 44 is inserted freely rotatably and movably in the support opening 46. A support part 48 is formed by the rotational shaft 44 and the support opening 46. The support opening 46 includes two arc parts having inner radii that are substantially the same as the radius of the rotational shaft 44, at both ends in the direction of the center line in the longitudinal direction, that is, the longer axis sh1. The both ends are the upper and lower ends of the support opening 46 in the present embodiment.

The support opening 46 is formed to extend vertically in the present embodiment such that the center line in the longitudinal direction, that is, the longer axis sh1, is directed to the nip part 47 of the first registration rollers 42*a* and 42*b*. In the present embodiment, the support opening 46 is formed to extend vertically with respect to the drawing (in the vertical direction). However, the support opening 46 may formed such that the longer axis sh1 falls within an angle β formed by the vertical direction and a common internal tangent line k2 of the first registration roller 42*a* and 42*b*. The common inner tangent line k2 extends along the sheet carrying direction in the nip part 47.

In the present embodiment, the rotational shaft 44 is formed on the guide 43 as the first engagement part, and the support opening 46 is formed as the first engaged part on the support member 45. However, the support opening may be formed on the guide 43 as the first engaged part, and the rotational shaft may be formed as the first engagement part on the support member 45.

In addition, a regulation surface S1 is formed as a first regulation part on a surface of the support member 45 that faces the cover 59, for contacting the guide 43 located at the guide position, holding and positioning the guide 43 when the cover 59 is closed. In addition, a regulation surface S2 is formed as a second regulation part on a surface of the contact rib 90 of the cover 59 that faces the support member 45, for contacting the tip end part 53 of the guide when the cover 59 is opened and closed, and for contacting the guide 43 located at the guide position, holding and positioning the guide 43 when the cover 59 is closed.

The regulation surface S1 is formed to extend vertically so as to be parallel with the longer axis sh1. A center axis of the first registration roller 42*a* is located on a plane extended from the regulation surface S1. The regulation surface S2 is formed to incline by a predetermined angle α1 so as to separate away from the regulation surface S1 in the upper part.

The engagement protrusion 30 is in a U shape and includes a first contacted part 49 formed to face the support member 45, a second contacted part 50 formed to face the cover 59, and a connection part 51 that connects the first contacted part 49 and the second contacted part 50. The first contacted part 49 includes a regulated surface S3 (first regulated part) that surface-contacts the regulation surface S1 when the cover is closed. The second contacted part 50 includes a first regulated surface S4 (second regulated part) that surface-contacts the regulation surface S2 when the cover 59 is closed, and a second regulated surface S5 (third regulated part) that rocks together with a sliding part p1 at the upper end of the regulation surface S2 when the cover 59 is opened and closed for moving the guide 42 to the sheet carrying direction. The first regulated surface S4 inclines by the angle α1 so as to separate away from the regulated surface S3 in the upper end. The second regulated surface S5 is inclined by an angle θ1 larger than the angle α1 so as to separate away from the regulated surface S3 in the upper end.

As described above, because the regulation surface S1 and the longer axis sh1 of the support opening 46 are in parallel, the guide 43 is moved in the direction of the longer axis sh1 of the support opening 46 to be located at the guide position and the first shunt position while the regulation surface S1 and the regulated surface S3 are in surface-contact with each other.

Moreover, a stop surface 53 is formed as a second engaged part in the support member 45 for preventing the guide from being rotated by an angle greater than a predetermined angle when the cover 59 is opened. When the guide 43 rotates by the weight of the guide 43 and when the stopper 57 contacts the stop surface 58, the further rotation is prevented. In the present embodiment, the stopper 57 as the second engagement part is formed on the sidewall part 43*b*, and the stop surface 58 as the second engaged part is formed on the support member 45. However, the stop surface as the second engaged part may be formed on the sidewall part 43*b*, and the stopper as the second engagement part is formed on the support member 45.

Next, a state of the guide 43 when the cover 59 is closed is explained.

Figure 9:
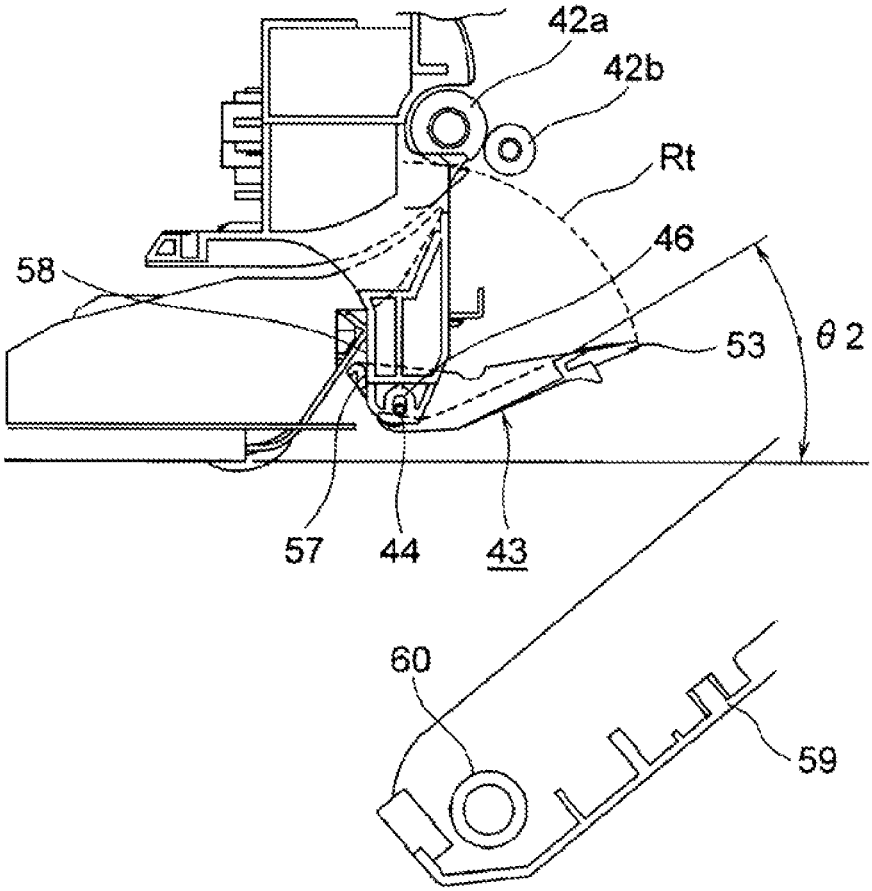
FIG. 9 illustrates a first state of the medium carrying device according to the first embodiment of the present application.
Figure 10:
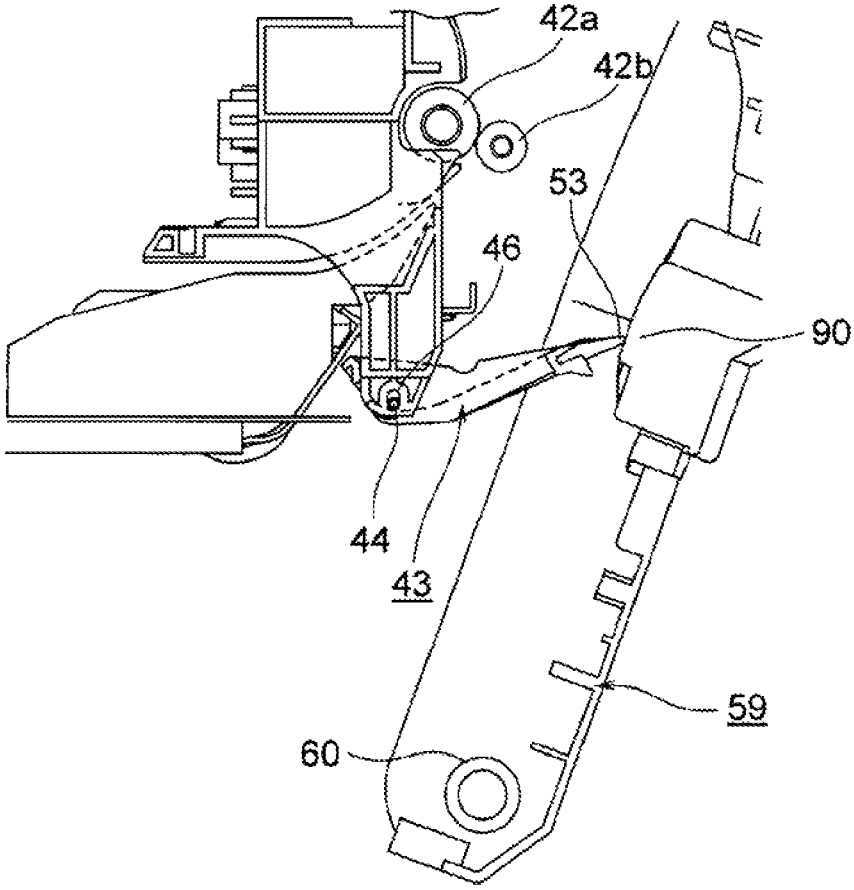
FIG. 10 illustrates a second state of the medium carrying device according to the first embodiment of the present application.
Figure 11:
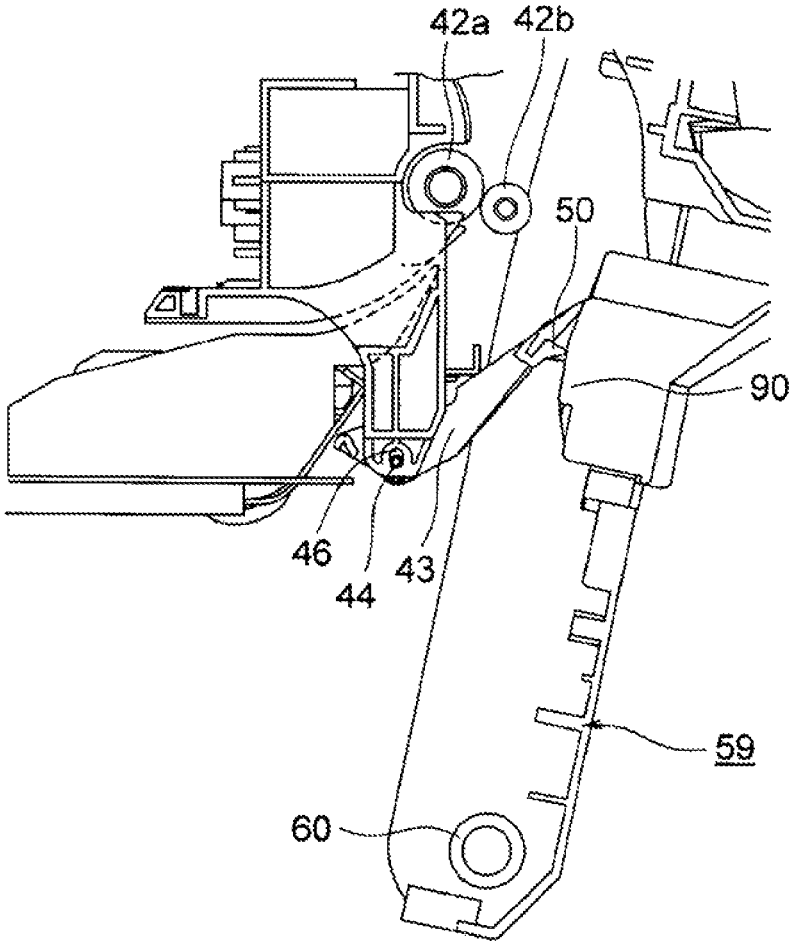
FIG. 11 illustrates a third state of the medium carrying device according to the first embodiment of the present application.
Figure 12:
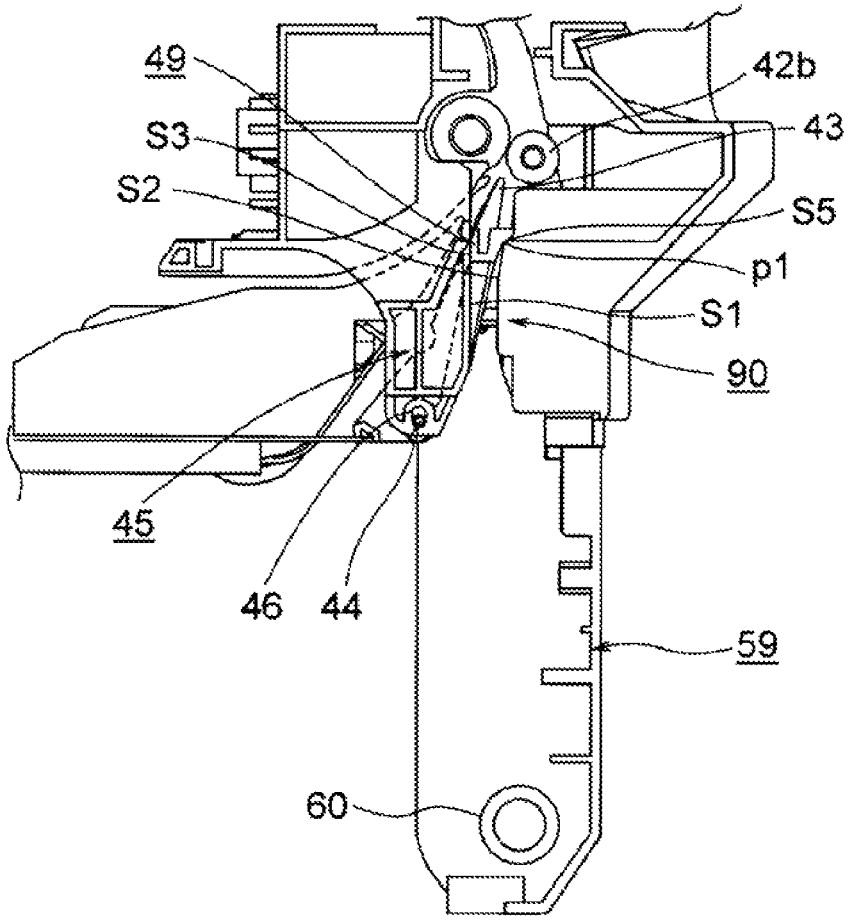
FIG. 12 illustrates a fourth state of the medium carrying device according to the first embodiment of the present application.
Figure 13:
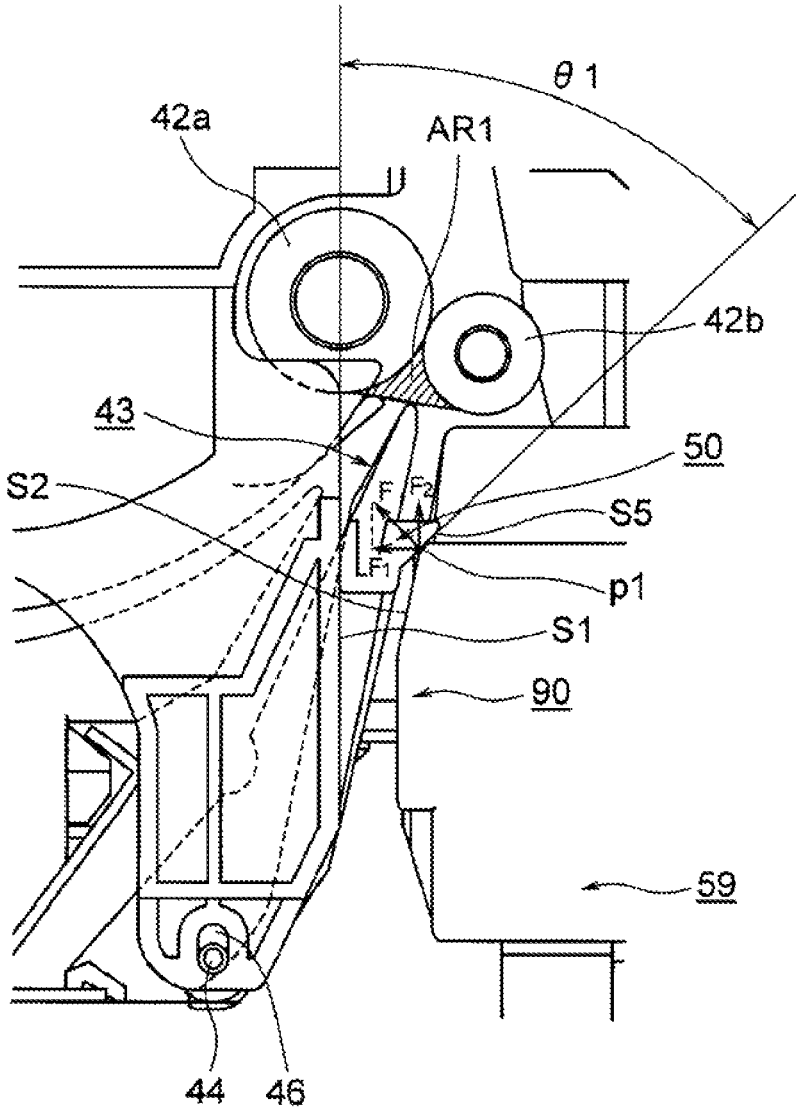
FIG. 13 illustrates a fifth state of the medium carrying device according to the first embodiment of the present application.

FIG. 9 illustrates a first state of the medium carrying device according to the first embodiment of the present application. FIG. 10 illustrates a second state of the medium carrying device according to the first embodiment of the present application. FIG. 11 illustrates a third state of the medium carrying device according to the first embodiment of the present application. FIG. 12 illustrates a fourth state of the medium carrying device according to the first embodiment of the present application. FIG. 13 illustrates a fifth state of the medium carrying device according to the first embodiment of the present application.

As shown in FIG. 9, in a state where the cover 59 is open, the guide 43 tilts by the weight of the guide 43 at the maxim angle and is positioned at the second shunt position. The rotational shaft 44 is positioned at the lowest end position of the support opening 46. At this time, the stopper 57 contacts the stop surface 58, and thereby the further rotation of the guide 43 is regulated.

Moreover, when the guide 43 is located at the first and second shunt positions, the arc trajectory Rt that the tip end part 53 draws while the guide 43 rocks and the outer circumferential surface of the first registration roller 42*b* do not intersect. Therefore, when the guide 43 rotates, the guide 43 and the first registration roller 42*b* do not interfere with each other.

Further, the guide 43 is tilted by a predetermined angle θ2 with respect to the installation surface (surface in the horizontal direction) of the printer 11 (FIG. 2) when the guide 43 is located at the second shunt position. Therefore, because the carrying path is widely opened, the sheet can be easily removed when a jam occurs, thereby making the jam release easy.

In the present embodiment, the angle θ2 is set to 0° or more and 80° and less but more preferably 10° or more and 45° or less in order to allow the guide 43 to easily rotate.

Then, when the cover 59 is closed by rotating the cover 59 about the support shaft 60 by a predetermined angle, the contact rib 90 of the cover 59 contacts the tip end part 53 of the guide 43 as shown in FIG. 10. Next, when the cover 59 is further rotated and closed, the tip end part 53 is pushed by the contact rib 90, and thereby the guide 43 rotates with the rotational shaft 44 as the center of rotation. At this time, the rotational shaft 44 is located at the lowest position of the support opening 46.

Moreover, when the cover 59 is further rotated and closed, the contact rib 90 contacts the second contacted part 50 of the guide 43, and thereafter, the second contacted part 50 is pushed by the contact rib 90 as shown in FIG. 11. Therefore, the guide 43 is further rotated.

Next, when the cover 59 is further rotated and closed, the regulated surface S3 of the contacted part 49 of the guide 43 contacts the regulation surface S1 of the support member 45 as shown in FIG. 12, and thereby the further rotation of the guide 43 is regulated. Therefore, the guide 43 is located at the first shunt position. In addition, the sliding part p1 at the upper end of the regulation surface S2 contacts the second regulated surface S5 of the first contacted part 49.

In the state shown in FIG. 12, the cover 59 is not completely closed. The rotational shaft 44 is positioned at the lowest position of the support opening 46 since the closure of the cover 59 is started. The guide 43 is rotated while the rotational shaft 44 is positioned at the lowest position of the support opening 46. Therefore, the tip end part 53 of the guide 43 is located outside the interference area AR1, and a predetermined space is formed between the tip end part 53 and the first registration roller 42*b*. Therefore, the guide 43 is smoothly rotated.

Next, when the cover 59 is further rotated and closed, because the second regulated surface S5 inclines by the angle θ1 with respect to the regulated surface S3, a force F by which the sliding part p1 pushes the second regulated surface S5 is broken into a component force F1 ($F1=F\cdot\cos\theta1$) that acts in the direction perpendicular to the regulation surface S1 and a component force F2 ($F2=F\cdot\sin\theta1$) that acts in the direction parallel to the regulation surface S1, as shown in FIG. 13.

As described above, because the regulation surface S1 and the longer axis sh1 of the support opening 46 are in parallel, the guide 43 is moved towards the downstream side of the sheet carrying direction along the regulation surface S1 due to the component force F2 and is therefore positioned at the guide position. At this time, the rotational shaft 44 is located at the highest position of the support opening 46 as shown in FIG. 1. In this state, the cover 59 is fixed by a rock part (not shown) of the device main body.

In the present embodiment, the angle θ1 is set to 20° or more and 80° or less but more preferably 45° or more and 80° or less to smoothly move the guide 43 along the regulation surface S1.

Therefore, in the present embodiment, by opening and closing the cover 59, the guide 43 rocks and is positioned at the guide position and the first and second shunt positions. As a result, merely by opening the cover 59, the guide 43 is positioned at the second shunt position. Therefore, a jam can be easily removed when the jam occurs.

In addition, the tip end part 53 of the guide 43 is located outside the interference area AR1 while the guide 43 is positioned at the first shunt position. Therefore, when he guide 43 is rocked between the first and second shunt positions for removing the jam and attaching and detaching the various units, the guide 43 and the first registration rollers 42*a* and 42*b* are prevented from interfering from each other.

Moreover, when the guide 43 is positioned at the guide position while the cover 59 is closed, the tip end part 53 is moved in the vicinity of the nip part 47 (FIG. 1) between the first registration rollers 42*a* and 42*b*. Therefore, the sheet is accurately guided to the vicinity of the nip part 47. Accordingly, the sheet is smoothly carried without the folding phenomenon and the like in which front end of the sheet hits the first registration rollers 42*a* and 42*b* and is folded to occur.

Moreover, because the tip end part 53 of the guide 43 is located outside the interference area AR1 while the guide 43 is positioned at the first shunt position. Therefore, the various units can be easily attached and detached to and from the device main body.

Next, a second embodiment of the present application is explained. Parts that include the same configurations as those in the first embodiments are indicated by the same reference numerals. Effects of such parts are the same as those described in the first embodiment.

Figure 14:
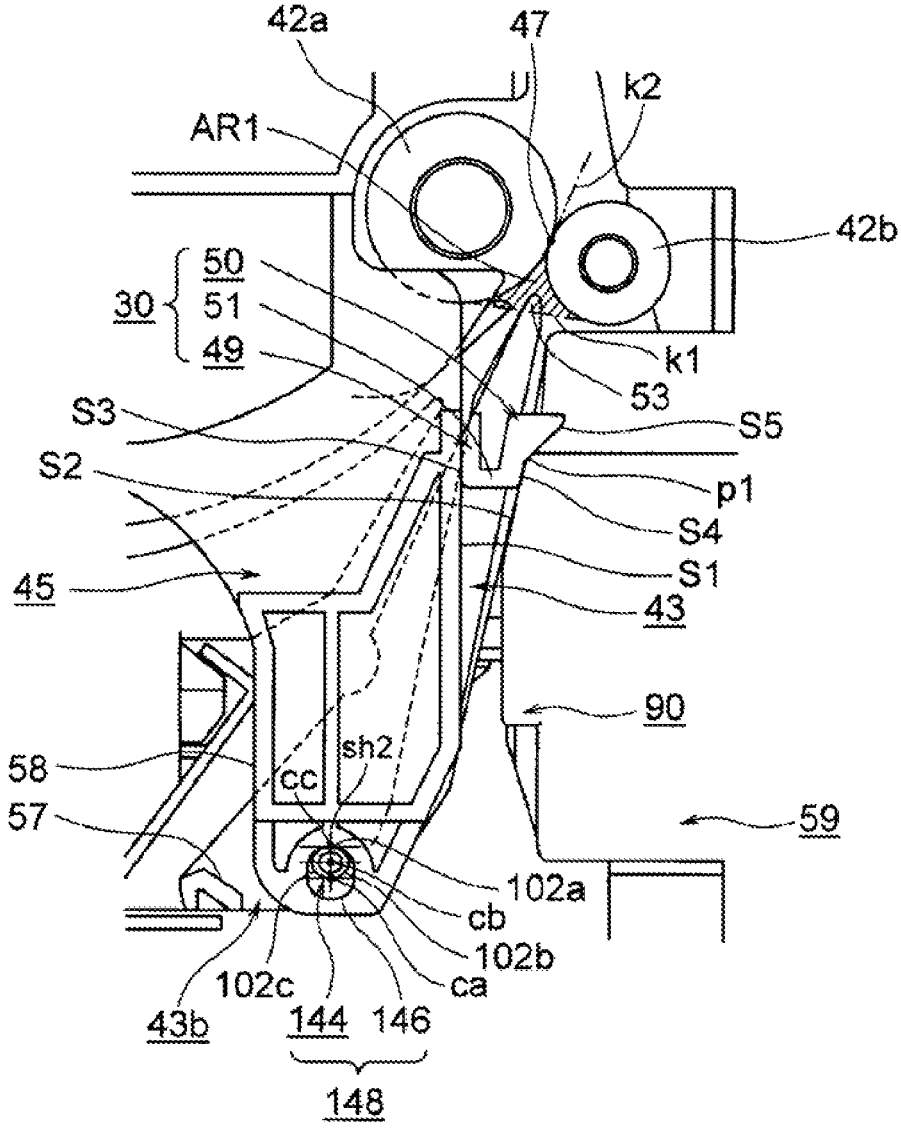
FIG. 14 is a cross-sectional view illustrating the main part of the medium carrying device according to a second embodiment of the present application.
Figure 15:
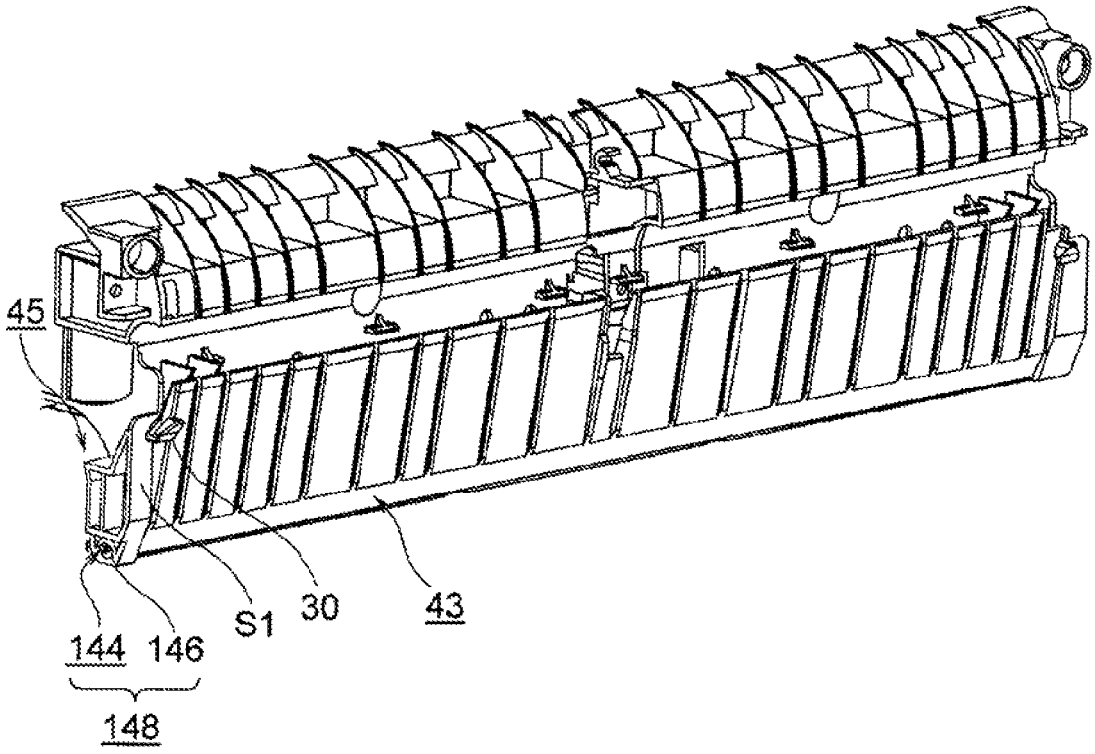
FIG. 15 is a first perspective view illustrating the main part of the medium carrying device according to the second embodiment of the present application.
Figure 16:
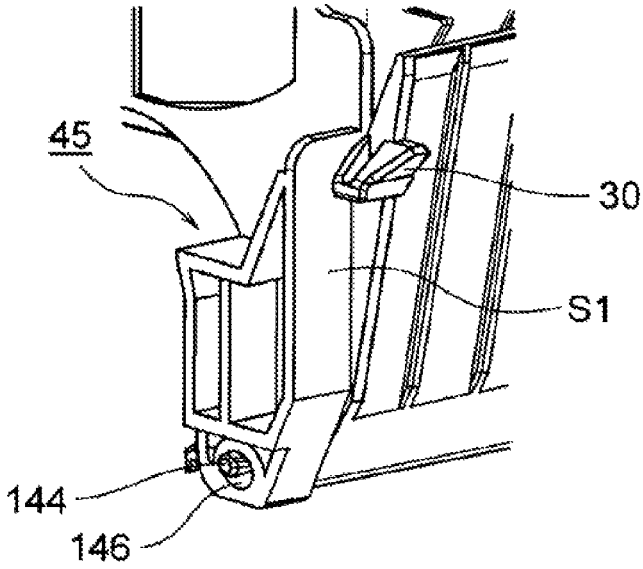
FIG. 16 is a second perspective view illustrating the main part of the medium carrying device according to the second embodiment of the present application.
Figure 17:
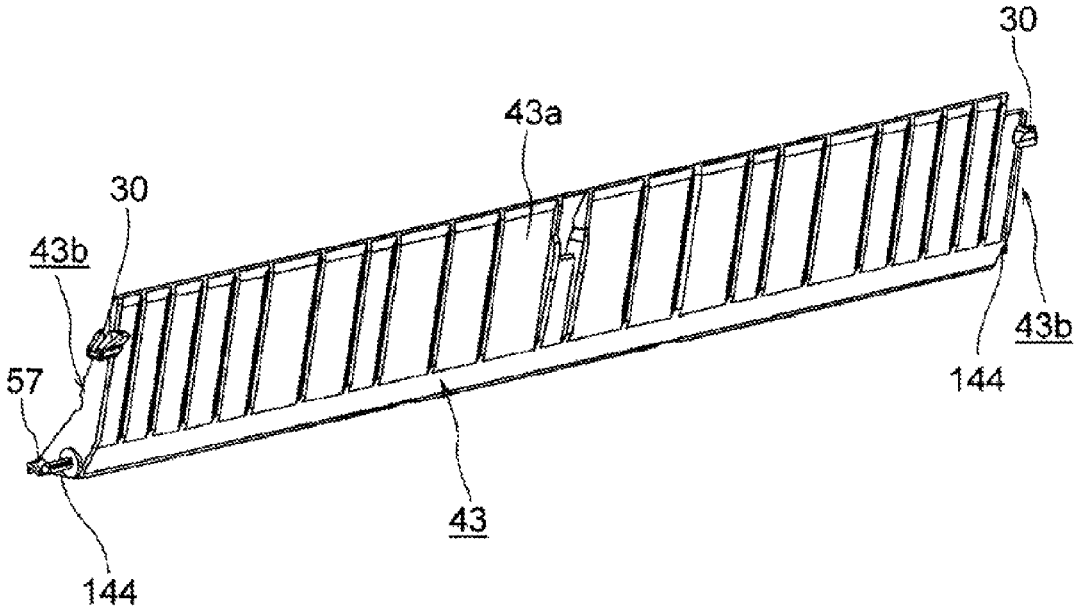
FIG. 17 is a perspective view of the guide according to the second embodiment of the present application.
Figure 18:
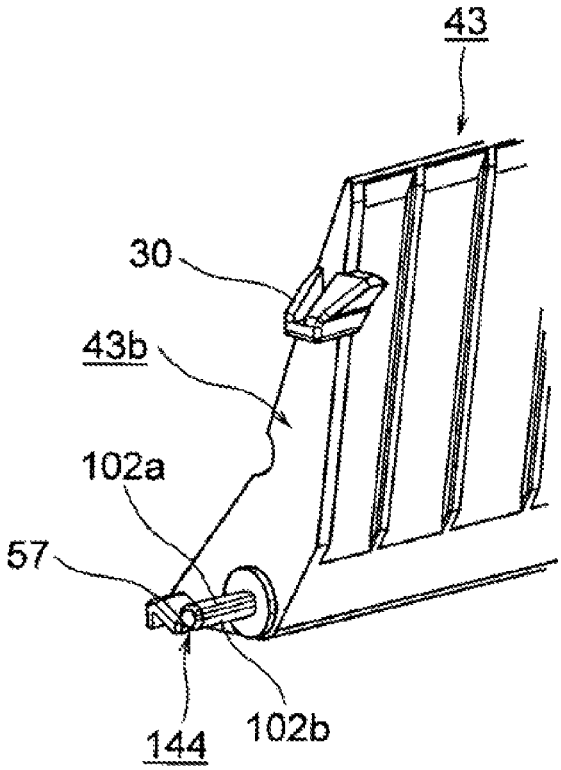
FIG. 18 is a perspective view of a main part of the guide according to the second embodiment of the present application.

FIG. 14 is a cross-sectional view illustrating the main part of the medium carrying device according to the second embodiment of the present application. FIG. 15 is a first perspective view illustrating the main part of the medium carrying device according to the second embodiment of the present application. FIG. 16 is a second perspective view illustrating the main part of the medium carrying device according to the second embodiment of the present application. FIG. 17 is a perspective view of the guide according to the second embodiment of the present application. FIG. 18 is a perspective view of a main part of the guide according to the second embodiment of the present application.

Near the lower end of each of the sidewall part 43*b*, a rotational shaft 144 as a first engagement part and a stopper 57 as a second engagement part are formed. Near the upper end, an engagement protrusion 30 as a contacted part is formed. The respective rotational shaft 144, stopper 57 and engagement protrusion 30 are formed to project in the longitudinal direction of the guide 43 as a guide member.

The guide 43 is positioned at the guide position when the cover 59, which is a guide position changing part and an opening and closing member, is closed and at the first and second shunt positions when the cover 59 is opened. At the guide position, the tip end part 53 of the guide 43 is positioned inside the interference area AR1. At the first shunt position, the tip end part 53 of the guide 43 is positioned outside the interference area AR1. When the tip end part 53 of the guide 43 is at the second shunt position, the carrying path for the sheet as a medium is opened.

As a result, a support opening 146 is formed as a first engaged part that has a circular shape and is configured by an opening with a predetermined radius r1, near the lower end of the support member 45 as a second support body. The rotational shaft 144 is inserted freely rotatably and movably in the support opening 146. A support part 148 is formed by the rotational shaft 144 and the support opening 146.

The rotational shaft 144 includes at least two (plurality of) arcs. In the present embodiment, the rotational shaft 144 includes three arcs 102*a*, 102*b* and 102*c* as first to third parts. The arcs 102*a*, 102*b* and 102*c* have relationships of ra=rc>rb, where ra, rb and rc are curvature radii of the arcs 102*a*, 102*b* and 102*c*, respectively. Curvature centers ca, cb and cc of the respective arcs 102*a*, 102*b* and 102*c* are offset from each other on the axial line sh2 that is parallel with the regulation surface S1 in a state where the guide 43 is at the guide position, as shown in FIG. 14.

Moreover, the radius r1 of the support opening 146 is equal to, or slightly larger than, radii of the predetermined arcs among the arcs 102*a*, 102*b* and 102*c*, that is, in the present embodiment, the curvature radii ra and rc of the arcs 102*a* and 102*c*.

In the present embodiment, the rotational shaft 144 is formed on the guide 43 as the first engagement part, and the support opening 146 is formed as the first engaged part on the support member 45. However, the support opening may be formed on the guide 43 as the first engaged part, and the rotational shaft may be formed as the first engagement part on the support member 45.

Next, a state of the guide 43 when the cover 59 is closed is explained.

Figure 19:
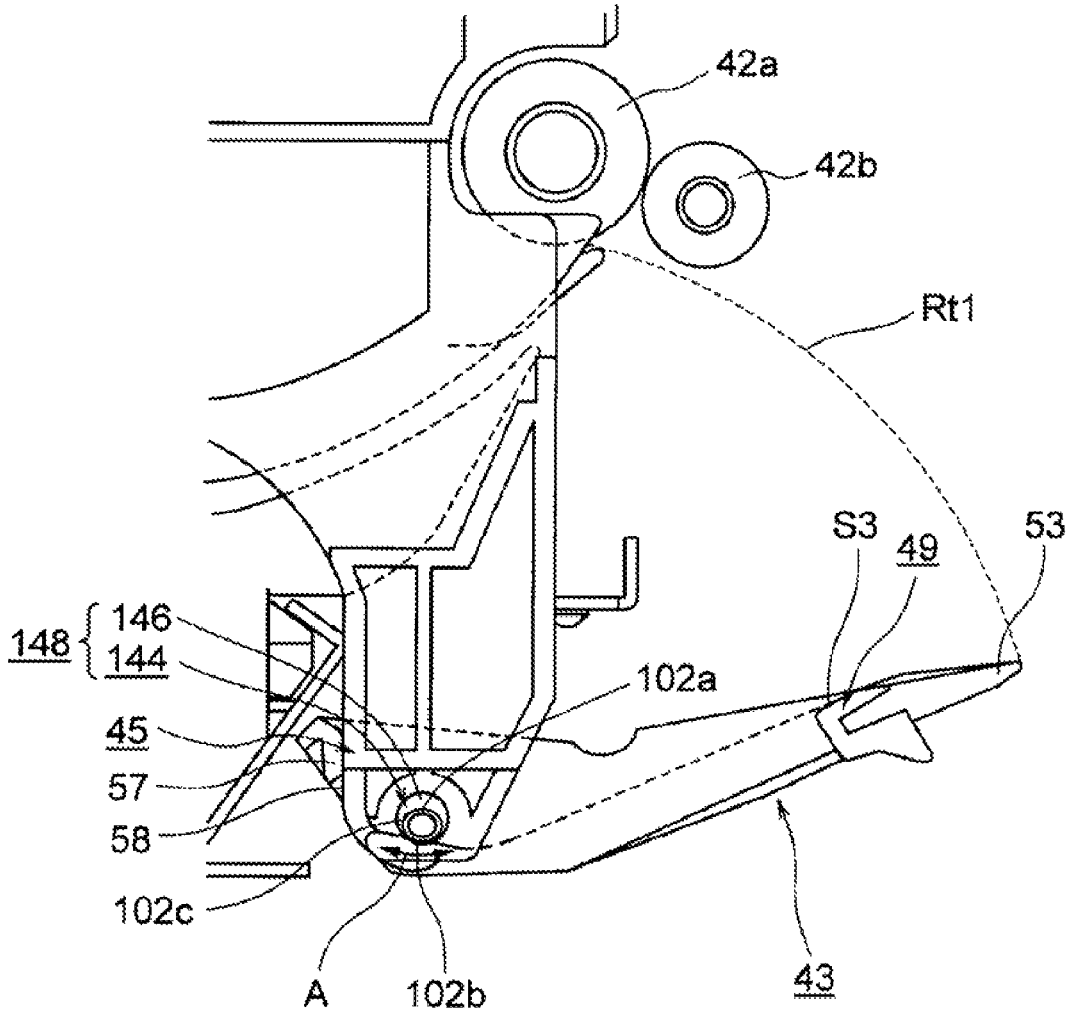
FIG. 19 illustrates a first state of the medium carrying device according to the second embodiment of the present application.
Figure 20:
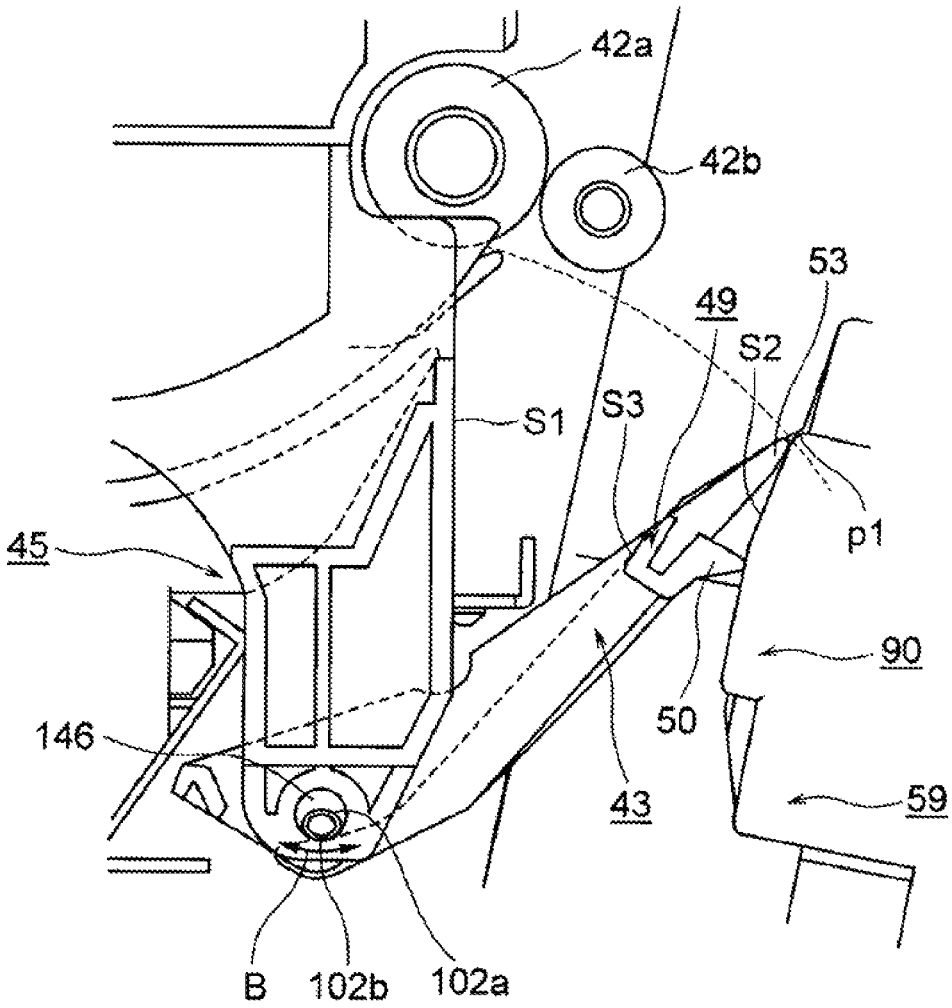
FIG. 20 illustrates a second state of the medium carrying device according to the second embodiment of the present application.
Figure 21:
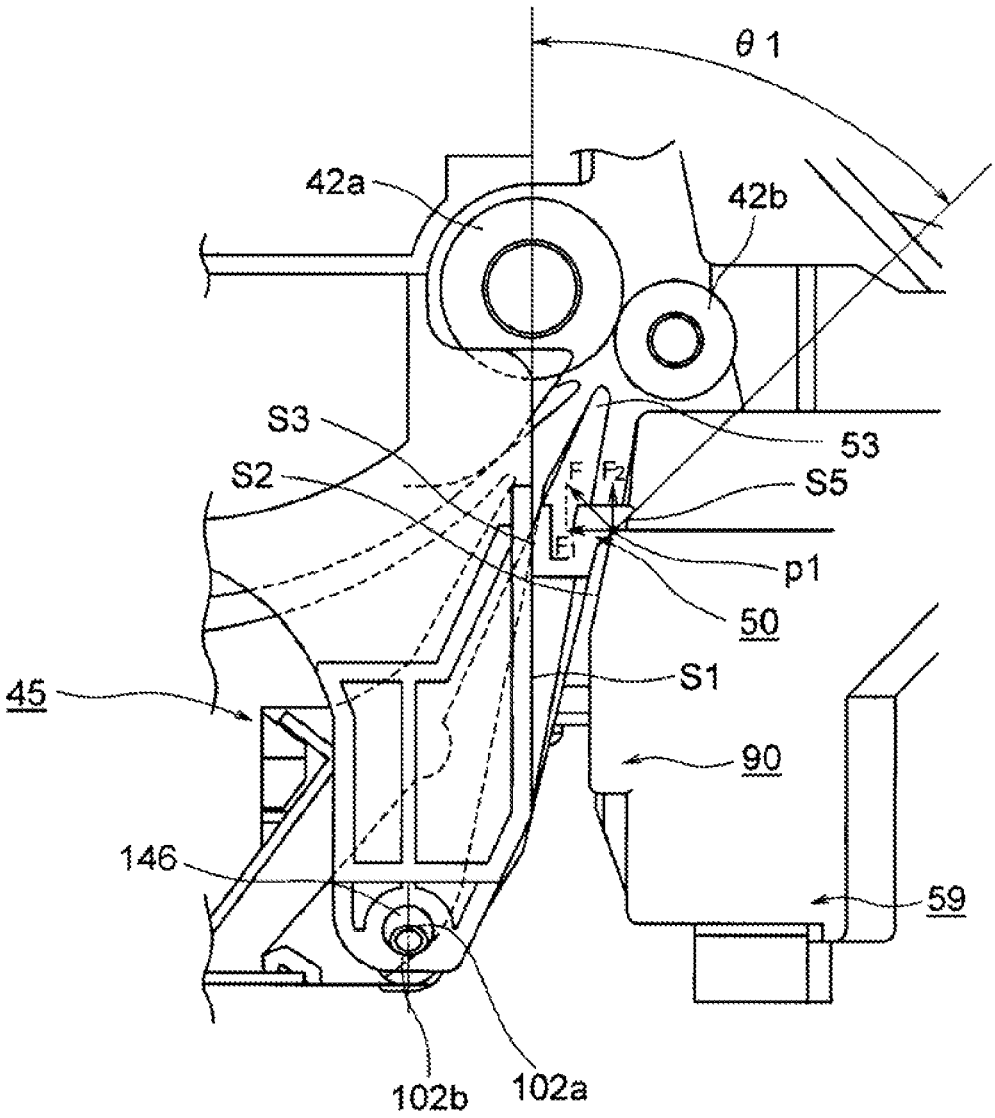
FIG. 21 illustrates a third state of the medium carrying device according to the second embodiment of the present application.

FIG. 19 illustrates a first state of the medium carrying device according to the second embodiment of the present application. FIG. 20 illustrates a second state of the medium carrying device according to the second embodiment of the present application. FIG. 21 illustrates a third state of the medium carrying device according to the second embodiment of the present application.

In a state where the cover 59 is open, the guide 43 tilts by the weight of the guide at the maxim angle and is positioned at the second shunt position. The rotational shaft 144 is positioned at the lowest end position of the support opening 146, and the arc 102*b* contacts an inner circumferential surface of the support opening 146 at the lowest end position. At this time, the stopper 57 contacts the stop surface 58, and thereby the further rotation of the guide is regulated.

Moreover, when the guide 43 is located at the first and second shunt positions, an arc trajectory Rt1 that the tip end part 53 draws while the guide 43 rocks about the curvature center cb of the arc 102*b* as a rocking center, and the outer circumferential surface of the first registration roller 42*b* of the first registration rollers 42*a* and 42*b* of the first carrying roller pair do not intersect. Therefore, when the guide 43 rotates, the guide 43 and the first registration roller 42*b* do not interfere with each other.

In addition, because the curvature radius rb of the arc 102*b* is smaller than the radius r1 of the support opening 146, a degree of freedom of the rotational shaft 144 in the support opening 146 in the direction of arrow A increases. Therefore, the guide 43 can be smoothly rotated.

Then, when the cover 59 is closed by rotating the cover 59 about the support shaft 60 (FIG. 10) by a predetermined angle, the contact rib 90 as a contact part of the cover 59 and as a reinforcement part contacts the tip end part 53 of the guide 43. Next, when the cover 59 is further rotated and closed, the tip end part 53 is pushed by the contact rib 90, and thereby the guide 43 rotates with the rotational shaft 144 as the center of rotation. At this time, the rotational shaft 144 is positioned at the lowest end position of the support opening 146, and the arc 102*b* contacts an inner circumferential surface of the support opening 146 at the lowest end position.

Moreover, when the cover 59 is further rotated and closed, the contact rib 90 contacts the second contacted part 50 of the guide 43, and thereafter, the second contacted part 50 is pushed by the contact rib 90 as shown in FIG. 20. Therefore, the guide 43 is further rotated.

In this case also, because the rotational shaft 144 is positioned at the lowest end position of the support opening 146, and because the arc 102*b* contacts an inner circumferential surface of the support opening 146 at the lowest end position, the degree of freedom of the rotational shaft 144 in the support opening 146 in the direction of arrow B increases. Therefore, the guide 43 is smoothly rotated.

Next, when the cover 59 is further rotated and closed, the regulated surface S3 of the first contacted part 49 of the guide 43 contacts the regulation surface S1, as the first regulation part, of the support member 45, and thereby the further rotation of the guide 43 is regulated. In addition, the sliding part p1 at the upper end of the regulation surface S2 contacts the second regulated surface S5 of the contacted part 49.

Next, when the cover 59 is further rotated and closed, because the second regulated surface S5 inclines by the angle θ1 with respect to the regulated surface S3, a force F by which the sliding part p1 pushes the second regulated surface S5 is broken into a component force F1 ($F1=F\cdot\cos\theta1$) that acts in the direction perpendicular to the regulation surface S1 and a component force F2 ($F2=F\cdot\sin\theta1$) that acts in the direction parallel to the regulation surface S1, as shown in FIG. 21.

As described above, because the regulation surface S1 and the longer axis sh1 of the support opening 146 are in parallel, the guide 43 is moved towards the downstream side of the sheet carrying direction along the regulation surface S1 due to the component force F2 and is therefore positioned at the guide position. At this time, as shown in FIG. 14, the rotational shaft 144 is positioned at the highest end position of the support opening 146, and the arc 102*a* contacts an inner circumferential surface of the support opening 146 at the highest end position.

In this state, the cover 59 is fixed by a rock part (not shown) of the device main body.

In the present embodiment, the arcs 102*a*, 102*b* and 102*c* are formed on the rotational shaft 144, and the curvature radius rb of the arc 102*b* is made smaller than the radius of the support opening 146. Accordingly, the degree of freedom of the rotational shaft 144 in the support opening 146 is increased. Therefore, the guide 43 is smoothly rotated.

In addition, because the radius r1 of the support opening 146 is equal to or slightly larger than the curvature radius ra of the arc 102*a*, a contact area between the support opening 146 and the rotational shaft 144 increases. Therefore, the guide 43 is stably supported by the support opening 146.

In the present embodiment, the rotational shaft 144 is formed by three arcs 102*a*, 102*b* and 102*c*. However, the cross-section of the rotational shaft 144 may be formed in an oval shape.

The above-described embodiments are explained with a printer as an example. However, the embodiments may be adapted in various image forming devices, such as photocopy machines, facsimile machines, multi-functional peripherals (MFPs) and the like.

Moreover, in the above-described embodiments, the first registration rollers 42*a* and 42*b* are explained. However, the embodiments may be adapted in other carrying roller pairs.

In addition, in the above-described embodiments, the cover 59 is opened and closed to rock the guide 43. The sheet cassette 24 below the guide 43 may be used, instead of the cover 59 as the guide position changing part, to rock the guide 43 when the sheet cassette 24 is installed and removed. In that case, the engagement protrusion 30 as the regulated part may be positioned near the lower end of the guide 43. The contact part may be formed at a predetermined location of the sheet cassette 24, so that the contact part pushes the engagement protrusion 30 upon installation and removal of the sheet cassette 24.

Further, in the above-described embodiments, the explanation is made with a color printer that includes the image forming units 12Bk, 12Y, 12M and 12C. However, the embodiments may be adapted in a single-color printer that includes only the image forming unit 12Bk.

The present embodiments are not limited to those described above, and various changes and modifications are available without departing from the scope of the invention.

What is claimed is:

1. An information processing device, comprising:

a device main body;

a cover that is rotatable on a rotational axis, and that is openable and closable with respect to the device main body; and a rotatable guide that is separate from the cover, has a carrying surface for a medium that faces a carrying path for a medium, and has a back surface opposite to the carrying surface, wherein an inside of the cover contacts the back surface of the guide at a first position while the cover rotates in a closing direction, the guide is rotated by the cover pushing the back surface of the guide based on a rotation of the cover when the cover passes from the first position to a second position, and a tip end part of the guide is moved in a medium carrying direction of the carrying path by the cover pushing the back surface of the guide based on the rotation of the cover when the cover passes from the second to a third position, wherein the tip end part of the guide is moved in a first direction when the cover passes from the first position to the second position, and the tip end part of the guide is moved in a second direction that is different from the first direction when the cover passes from the second position to the third position.

2. The information processing device according to claim 1, further comprising:

an interference member that is positioned in a middle of an opening and closing trajectory of the cover;

a rotational shaft that is included on the guide, and around which the guide rotates; and a support member that includes a support opening to support the rotational shaft and that enables the rotational shaft to move to a shunt position when the cover moves to the second position, wherein the shunt position is an intermediate position of the guide, and the cover moves the guide to and from the shunt position by regulating the guide in the direction away from the interference member, and by regulating the guide in a direction toward the interference member.

3. The information processing device according to claim 2, wherein the support opening is an oblong opening that extends in the direction in which the guide is separated away from the interference member and engages with the rotational shaft.

4. The information processing device according to claim 2, wherein the rotational shaft includes a plurality of arcs on an outer periphery thereof, and the support opening is configured by a circular opening having an inner radius that is substantially equal to a radius of curvature of a predetermined one of the plurality of arcs.

5. The information processing device according to claim 2, further comprising:

a medium carrying device, wherein the cover is freely rotatable relative to the device main body, and the interference member comprises a first carrying roller that carries a medium.

6. The information processing device according to claim 5, wherein the interference member further comprises a second carrying roller that forms a nip part with the first carrying roller, the guide is configured to guide the medium to the nip area when the cover is in the third position, and the tip end part of the guide can move from inside to outside of an interference area surrounded by circumferential surfaces of the first and second carrying rollers and a common external tangent line of the first and second carrying rollers, and vice versa.

7. The information processing device according to claim 6, wherein the tip end part of the guide is moved into the interference area by contacting a slide part of the cover with a regulated surface of the guide when the cover is in the third position.

8. The information processing device according to claim 2, further comprising:

a medium carrying device, wherein the third position is a closed position and the first position is an open position, the cover is freely rotatable with respect to the device main body, and the interference member comprises a carrying roller that carries a medium, when the cover moves between the second position and the third position, the guide is rotated as a contact part provided on the cover contacts the guide, and the guide is moved to a nip part formed by the carrying roller as the contact part contacts a contacted part formed on the guide, when the cover moves between the third position and the second position, the guide is moved in a direction away from the nip part as the contact part is separated from the contacted part, and when the cover moves between the second position and the first position, the guide is rotated in an opening direction that is opposite the closing direction, as the contact part is separated from the guide.

9. The information processing device according to claim 2, wherein the support member includes a regulation surface, and the guide moves away from the interference member while the guide maintains contact with the regulation surface.

10. The information processing device according to claim 1, further comprising a medium carrying device, wherein the interference member comprises a first carrying roller that carries a medium.

11. The information processing device according to claim 10, wherein the interference member further comprises a second carrying roller that forms a nip part with the first carrying roller, the guide guides the medium to the nip area, and the tip end part of the guide moves from inside to outside of an area surrounded by circumferential surfaces of the first and second carrying rollers and a common external tangent line of the first and second carrying rollers when the cover moves from the third position to the second position.

12. The information processing device according to claim 1, wherein the information processing device comprises an image forming device.

13. The information processing device according to claim 1, wherein the tip end part of the guide gradually becomes thinner toward the tip end.

14. The information processing device according to claim 1, wherein the guide has a cutout at the tip end part.

15. The information processing device according to claim 1, wherein the guide has carrying ribs toward a medium carrying direction, which are parallel to each other, intervals of the carrying ribs placed on a center part of the guide being different from intervals of the carrying ribs placed an edge parts of the guide.

16. The information processing device according to claim 1, wherein the carrying surface of the guide has a dogleg-shaped bend.

17. A medium carrying device, comprising:

a device main body;

a cover that is rotatable on a rotational axis, and is openable and closable with respect to the device main body;

a carrying roller pair that is configured from first and second rollers and that carries a medium; and a rotatable guide that is separate from the cover, has a carrying surface that faces a carrying path for a medium, and has a back surface opposite to the carrying surface, wherein an inside of the cover contacts the back surface of the guide at a first position while the cover rotates in a closing direction, the guide is rotated by the cover pushing the back surface of the guide based on a rotation of the cover when the cover passes from the first position to a second position, and a tip end part of the guide is moved into an interference area configured by the first and second rollers and a common external tangent line of the first and second rollers by the cover pushing the back surface of the guide based on the rotation of the cover when the cover passes from the second to a third position, wherein the tip end part of the guide is moved in a first direction when the cover passes from the first position to the second position, and the tip end part of the guide is moved on a second direction that is different from the first direction when the cover passes from the second position to the third position.

18. The medium device according to claim 17, further comprising a support part that supports the guide rockably and freely movably to the nip part, wherein the support part comprises a rotational shaft formed on one of a support member and the guide, and a support opening formed on the other one of the support member and the guide, the support member being formed at a predetermined location on a frame of the device main body, the rotational shaft comprises a circular shaft, and the support opening comprises an oblong opening with a circular arc that has an inner radius that is substantially equal to a radius of the rotational shaft.

19. The medium carrying device according to claim 17, further comprising a support part that supports the guide rockably and freely movably to the nip part, wherein the support part comprises a rotational shaft formed on one of a support member and the guide, and a support opening formed on the other one of the support member and the guide, the support member being formed at a predetermined location on a frame of the device main body, the rotational shaft includes a plurality of arcs on an outer periphery thereof, and the support opening comprises a circular opening that has an inner radius that is substantially equal to a curvature radius of a predetermined one of the plurality of arcs.

20. The medium carrying device according to claim 17, wherein the cover covers the carrying roller pair and the guide, the guide is configured to guide the medium to a nip part defined by the carrying roller pair when the cover is in the third position, the guide is configured to rotate as a contact part provided on the cover contacts the guide, and is configured to move toward the nip part as the contact part contacts the contacted part formed on the guide, and the guide is configured to move in a direction away from the nip part as the contact part separates from the contacted part, and the guide is configured to rotate as the contact part separates from the guide, when the cover is moved from the second position to the first position.

21. An image forming device, comprising:

the medium carrying device according to claim 17.

22. The medium carrying device according to claim 17, wherein the tip end part of the guide gradually becomes thinner toward the tip end.

23. The medium carrying device according to claim 17, wherein the guide has a cutout at the tip end part.

24. The medium carrying device according to claim 17, wherein the guide has carrying ribs toward a medium carrying direction, which are parallel to each other, intervals of the carrying ribs placed on a center part of the guide being different from intervals of the carrying ribs placed an edge parts of the guide.

25. The medium carrying device according to claim 17, wherein the carrying surface of the guide has a dogleg-shaped bend.

26. A medium carrying device, comprising:

a support member including a first regulation part and one of a support opening and a rotational shaft, the rotational shaft being movable in a first direction within the support opening, the first regulation part extending in parallel to the first direction;

a guide including a first regulated part, a second regulated part, a third regulated part, and an other one of the support opening and the rotational shaft, the guide position being a position at which a tip end part of the guide is in an interference area defined by a carrying roller pair, a first shunt position being a position at which the tip end part of the guide is outside the interference area, a second shunt position being a position at which the guide is rotated and thereby the tip end part is farther from the carrying roller pair than the first shunt position; and a contact part that includes a second regulation part, wherein the tip end part of the guide contacts the contact part at the second shunt position, the first regulation part contacts the first regulated part, and the second regulation part contacts the third regulated part, when the guide is rotated by the contact part and reaches the first shunt position, and the tip end part enters the interference area, and the second regulation part contacts the second regulated part, when the guide is moved in the first direction and to the guide position by the contact part.

27. The medium carrying device according to claim 26, wherein a first angle formed by the first contacted part and the third contacted part is smaller than a second angle formed by the first contacted part and the second contacted part.

28. The medium carrying device according to claim 26, wherein a longer axis of the support opening falls within an angle formed by the first regulation surface and a common internal tangent line of the carrying roller pair.

* * * * *